US008281429B2

(12) United States Patent
Gunderson

(10) Patent No.: US 8,281,429 B2
(45) Date of Patent: Oct. 9, 2012

(54) ANAL-GENITAL VIEWING DEVICE AND METHOD

(76) Inventor: Vernon Wesley Gunderson, Las Vegas, NV (US)

( * ) Notice: Subject to any disclaimer, the term of this patent is extended or adjusted under 35 U.S.C. 154(b) by 372 days.

(21) Appl. No.: 12/577,321

(22) Filed: Oct. 12, 2009

(65) Prior Publication Data

US 2011/0083264 A1 Apr. 14, 2011

(51) Int. Cl.
*A47K 17/00* (2006.01)

(52) U.S. Cl. ..... 4/661; 362/135; 359/850

(58) Field of Classification Search ..... 4/661; 362/138–144, 135; 359/856, 860, 862, 850
See application file for complete search history.

(56) References Cited

U.S. PATENT DOCUMENTS

| | | | | |
|---|---|---|---|---|
| 1,607,163 | A | | 11/1926 | Kinter |
| 2,172,840 | A | | 7/1937 | Geffon |
| 2,598,291 | A | | 5/1952 | O'Brien |
| 2,943,184 | A | | 8/1956 | Christopherson |
| 3,075,516 | A | | 1/1963 | Strauch |
| 3,411,842 | A | | 11/1968 | Levy |
| 3,775,777 | A | | 12/1973 | Roberts, Jr. |
| 3,989,359 | A | * | 11/1976 | Shutt ..... 359/872 |
| 4,257,680 | A | | 3/1981 | Baczkowski |
| 4,623,955 | A | * | 11/1986 | Santini ..... 362/135 |
| 4,850,688 | A | | 7/1989 | Rosenberg |
| 4,925,285 | A | | 5/1990 | Dowdell |
| 5,043,852 | A | | 8/1991 | Gerstenberger |
| 5,301,068 | A | | 4/1994 | Minisci |
| 5,311,366 | A | | 5/1994 | Gerace |
| 6,273,575 | B1 | | 8/2001 | Downs |
| 6,385,782 | B1 | | 5/2002 | Schneider |
| 7,165,860 | B1 | | 1/2007 | Metzger |

* cited by examiner

*Primary Examiner* — Huyen Le
(74) *Attorney, Agent, or Firm* — Robert Ryan Morishita; Morishita Law Firm, LLC

(57) ABSTRACT

Viewing device comprised of two or more mirrors and an illumination component for self-viewing the anal-genital region while seated on a toilet bowl. The preferred embodiment comprises a forward mirror and a rear mirror positioned within a toilet bowl at angles with respect to each other, to the user's eye and to the user's anal-genital region such that when the user peers between slightly spread legs into the forward mirror an upward directed image of the user's anal-genital region is visible. The device preserves the region of the toilet bowl directly below the anal-genital region free of mirrors and all supportive apparatus.

6 Claims, 18 Drawing Sheets

ANAL-GENITAL VIEWING DEVICE AND METHOD

FIELD OF DISCLOSURE

This invention relates to a device and method for viewing of the anal-genital region.

BACKGROUND

In additional to simple hygiene, there are numerous diseases, disorders and conditions that make it desirable to visually inspect the anal-genital area for detection, treatment and monitoring progress of treatment of the same.

For example, according to the Mayo Clinic fifty percent of the population experience hemorrhoids by age 50. External hemorrhoids are those that occur outside of the anal canal. They are sometimes painful, and can be accompanied by swelling and irritation. External hemorrhoids are prone to thrombosis: if the vein ruptures and a blood clot develops, the hemorrhoid becomes a thrombosed hemorrhoid. Internal hemorrhoids occur inside the rectum. As the area lacks pain receptors, internal hemorrhoids are usually not painful and most people are not aware that they have them. Internal hemorrhoids, however, may bleed when irritated. Untreated internal hemorrhoids can lead to two severe forms of hemorrhoids: prolapsed and strangulated hemorrhoids. Prolapsed hemorrhoids are internal hemorrhoids that are so distended that they are pushed outside the anus. If the anal sphincter muscle goes into spasm and traps a prolapsed hemorrhoid outside the anal opening, the blood supply is cut off and the hemorrhoid becomes a strangulated hemorrhoid.

The treatment of hemorrhoids depends upon the severity of the hemorrhoids and, therefore, the medical community has developed grading systems. One such system grades the severity of internal hemorrhoids based on the degree of prolapse of internal hemorrhoids as follows:

Grade I: The hemorrhoids do not prolapse.

Grade II: The hemorrhoids prolapse upon defecation but spontaneously reduce.

Grade III: The hemorrhoids prolapse upon defecation but must be manually reduced.

Grade IV: The hemorrhoids are prolapsed but cannot be manually reduced.

A less frequent but far more serious anal disorder is anal cancer. Cancers of the alimentary canal immediately above the anus are called rectal cancers. Cancers of the hair-bearing skin outside the anus are classified with skin cancers. The National Cancer Institute estimates 5,290 new cases of anal cancer in the United States in the year 2009 and at 40,870 of rectal cancer. According to the National Cancer Institute, risk factors for anal cancer include anal redness, anal swelling, anal soreness and anal fistulas (abnormal openings). Anal cancer may be accompanied by bleeding, pain, itching discharge or a lump.

Stages of anal cancer are:

Stage 0: Abnormal cells are found in the innermost lining of the anus.

Stage I: Cancer has formed and the tumor is two centimeters or smaller.

Stage II: The tumor is larger than two centimeters.

Stages IIIA and IIIB: The tumor may be of any size and has spread to lymph nodes near the rectum, groin or pelvis; and/or spread to nearby organs.

Stage IV: The tumor may be of any size and cancer has spread to lymph nodes or to nearby organs and to distant parts of the body.

When detected at stage 0, the treatment is surgical removal. Treatments for Stages I, II and III include surgery, radiation and chemotherapy. Treatments for Stage IV anal cancer are mostly palliative. As with all cancers, success of anal cancer treatment is largely dependent upon early detection, and early detection is greatly enhanced by visual inspection of the anal-genital region.

Other diseases that affect the anal-genital region as listed by the Center for Disease Control include the Sexually Transmitted Diseases (STDs) Chlamydia, Gonorrhea, Trichomoniasis, herpes, Syphilis, Human Papillomavirus, and Bacterial Vaginitis. Several of these diseases in early stages present as sores in the anal-genital region. In the case of syphilis, a single sore called a chancre appears during the Primary Stage, lasts three to six weeks and then heals without treatment. Treatment of syphilis with antibiotics is simple and effective in the Primary Stage. If not detected and treated in the Primary Stage or the Secondary Stage (skin rashes), syphilis enters the Latent (hidden) Stage of progressive damage to internal organs, including the brain. As with anal cancer, successful treatment of STDs depends to a large extent upon early detection, and early detection often depends upon visual inspection of the anal-genital region.

A need exists for people to be able to conveniently visually inspect their anal-genital regions. It is desirable to be able to conveniently view the anal-genital region in general and because some anal conditions including but not limited to internal hemorrhoids become more visible during defecation, it is also desirable to be able to view the anus during a bowel movement. In addition, it is desirable in some circumstances to take photographs of the anus during or immediately subsequent to defecation to provide to a medical provider to assist in disease or disorder diagnosis. The present invention provides a means of visual self-inspection of the anal-genital region and a means of visual inspection by third parties of the anal-genital region not provided by prior art.

There are other devices for self-inspection. U.S. Pat. No. 4,623,955, which issued Nov. 18, 1986 to Santini and U.S. Pat. No. 3,989,359, which issued Nov. 2, 1976 to Shutt, disclose toilet-mounted devices for self-examination of the anal-genital region. Both devices mount underneath the seat of the toilet using a brace, which supports a single mirror utilized to perform self-inspection of the anal-genital region. A user sits on the toilet seat and inspects herself/himself using the mirror supported by the brace. In the case of Santini the mirror is positioned directly beneath the anal-genital region, which precludes inspection of the anus during a bowel movement without soiling the device and precludes taking of photographs during the bowel movement. In the case of Shutt, the positioning of the mirror outside the toilet bowl cavity requires awkward body positions for inspection of the anus and precludes inspection of the anus during bowel movements.

Though the preceding discussion illustrates exemplary illustrations of purpose and use of this invention, they are certainly not all-inclusive, and the uses described, therefore, are not limiting. Accordingly, the invention can be used to inspect the anal-genital region for any reason or purpose including but not limited to disease symptom discovery, monitoring progress during disease or disorder treatment, visual guidance during application of medications and ointments, visual guidance during insertion of enema tips, visual guidance during removal of body hair and toilet training of children.

SUMMARY OF THE INVENTION

Disclosed herein is a device for viewing the anal-genital region of a person seated on a toilet. The device includes at least one front mirror and one rear mirror positioned in the toilet in such a way so as to provide at least one line of sight from outside the toilet to anal-genital region of the person seated on the toilet. The mirrors of the device may be attached to the interior wall of said toilet and may include means for adjusting the line of sight. In one embodiment, the mirrors of the device may comprise and be built into at least a portion of the interior wall of the toilet. The mirrors may be positioned within the toilet in many different ways. For example, the mirrors could be attached to clips which are configured to hang on the rim of said toilet. The clips may include means for adjusting the line of sight. In another embodiment, the mirrors of the device may instead be attached to the seat or rim of the toilet and may in this embodiment also include means for adjusting the line of sight.

The mirrors of the device may also be attached to a frame and the frame positioned in such a manner so as to position the mirrors in such a way that the mirrors are below the rim of said toilet and provide the desired line of sight. The frame may rest on the rim of the toilet, be attached to the rim of the toilet or be attached to the seat of the toilet. The frame may include means for adjusting the line of sight.

The mirrors of the device may also be attached to a housing and the housing positioned in such a manner so as to position the mirrors in such a way that mirrors are below the rim of the toilet and provide the desired line of sight. The housing may rest on the rim or seat of the toilet.

Also disclosed herein is a device for viewing the anal-genital region of a person seated on a toilet, the device including at least one front mirror, a rear mirror, and means for positioning the mirrors in the toilet to provide at least one line of sight from outside the toilet to the anal-genital region of the person seated on the toilet. The device may include means for adjusting the line of sight.

Finally disclosed is a method for viewing the anal-genital region of a person seated on a toilet. The method includes positioning at least one front mirror and one rear mirror in the toilet in such a way so as to provide at least one line of sight from outside the toilet to the anal-genital region of the person seated on the toilet.

Thus it can be understood, that the present invention provides a simple and effective means of inspection of the anal-genital region, without obstructing the area within the toilet bowl directly beneath the anus, by means of multiple mirrors positioned within a toilet bowl. In one embodiment, two mirrors are positioned within a toilet bowl, one at the front and the second at the rear, at specific angles in relation to each other, to the anal-genital region and to the user's eye such that an upward-directed view of the anal-genital region is provided to the user while seated on the toilet seat and peering downward between spread legs into the front mirror. The user's line of sight is reflected off the specifically-angled front mirror to the specifically-angled rear mirror and then reflected off the specifically-angled rear mirror upward toward the user's anal-genital region, providing to the user a view of the anal-genital region not afforded by the prior art without obstruction of the region of the toilet bowl directly below the user's anal-genital region. The user could also include a third-party caregiver. That is to say that by standing generally above the toilet the third-party caregiver would also have a line of sight reflected off the front mirror to the rear mirror and then to the anal-genital region of the person sitting on the toilet seat. One or more illumination components provide both diffuse illumination within the toilet bowl generally and/or anal-genital directed illumination specifically as may be desired by the user.

The mirrors may be positioned within the toilet bowl by a wide variety of methods, including but not limited to: (a) mirrors that are independently and individually mounted directly on the inner surfaces of the toilet bowl or built into the toilet bowl surfaces during manufacture, (b) mirrors that are independently and individually suspended from the toilet bowl rim and/or from the toilet seat, (c) collapsible frame-mounted and user-adjustable unitized mirror systems incorporating hinges, swivels or pivots; said frame being suspended from the toilet bowl rim or from the toilet seat, and (d) enclosure of the mirrors within a shell to form a sturdy drop-in unitized housing with a flange that rests upon the toilet bowl rim or seat.

A variety of embodiments illustrating means of positioning multiple-mirror viewing systems within a toilet bowl are presented herein, illustrating a range of complexity but not showing every possible variation of positioning the mirrors, or combinations of methods of supporting the mirrors, within a toilet bowl to accomplish the goal and purpose of the present invention. Numerous additional variations in construction of the present invention may be developed by a person skilled in the art without straying from the intended scope and field of the invention described herein.

DETAILED DESCRIPTION OF THE INVENTION

Figure 1:
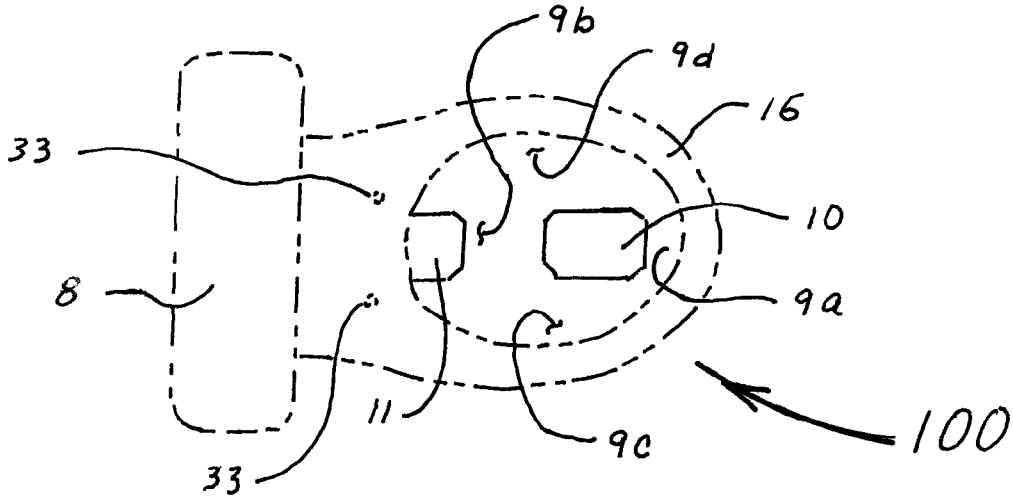
FIG. 1 is a top view of one embodiment of the anal-genital viewing device disposed in a toilet bowl.

While the present invention can be used in conjunction with any toilet, the device 100 is shown herein used in conjunction with a typical water flushable toilet bowl generally found in the home. However, it should be noted that various embodiments of the device 100 could be used in toilets with or without toilet seats or lids, with or without various means of attaching toilet seats or lids to the toilet bowl, and with various means of water delivery systems to the bowl.

As shown in FIGS. 1 through 6, the toilet 4 has a waste receptacle area containing water 5 and a void area 6 above the high water line shown by line 7. The toilet 4 generally has a water storage tank 8 containing the water (not shown) and flushing means (not shown) which initiates a flow of water from the water storage tank 8 through a conduit (not shown) into the bowl, generally through the interior of the hollow rim 16 and is dispersed through holes (not shown) lining the underside of the rim 16 generally over and around the wall 9*a*-9*d* that forms the interior of the bowl or void area 6. Although generally circular, semi-circular or oval in nature, the toilet bowl wall 9*a*-9*d* may be considered to have four distinct areas for the purposes of describing the invention herein: the front wall 9*a*; the rear wall 9*b*; the right wall 9*c*; and the left wall 9*d*. A toilet seat 15 and a toilet lid 22 may be attached to the area of the rear of the toilet bowl rim 16 by means of two hinges 17 secured by threaded projections (not shown) that pass through holes 33 in the toilet rim surface or by other attachment means. The hinges 17 permit the toilet seat 15 and toilet lid 22 to be concurrently or consecutively rotated from the front of the water storage tank 8 toward the toilet bowl 4 through an arc designated by the dashed line 19 to rest upon the bowl rim 16. The toilet seat 15 generally includes on its underside two spacers 20 which maintain a short distance between the toilet seat 15 and the bowl rim 16 when the toilet seat is in the lowered position.

Figure 2:
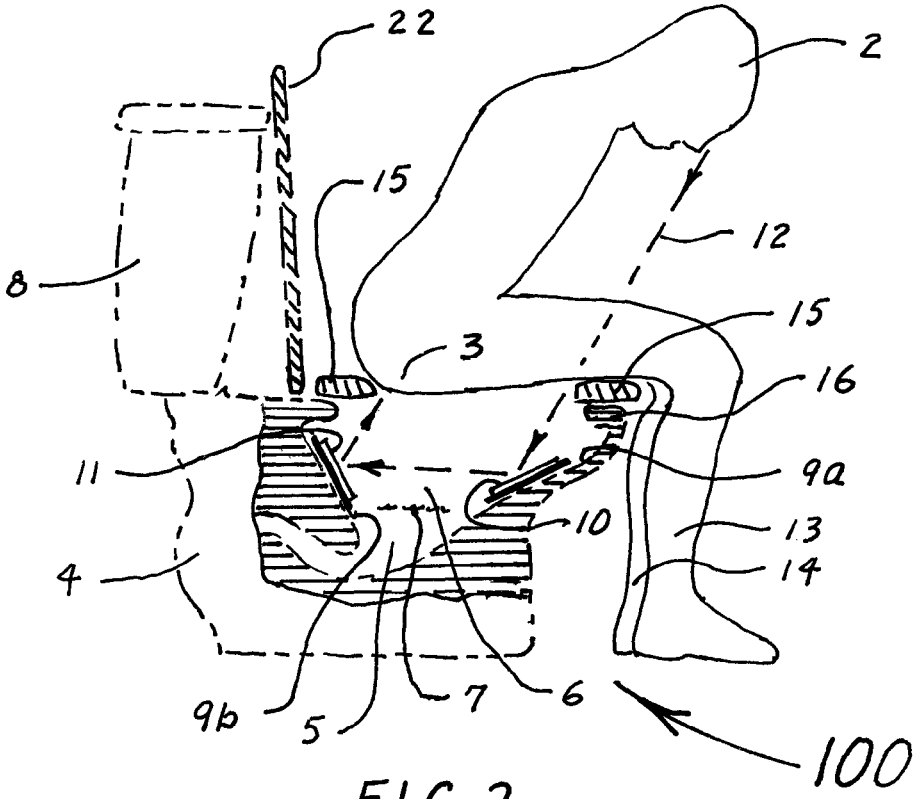
FIG. 2 is a partial sectional side elevation view of one embodiment of the anal-genital viewing device disposed in a toilet bowl and being used by a person.
Figure 3:
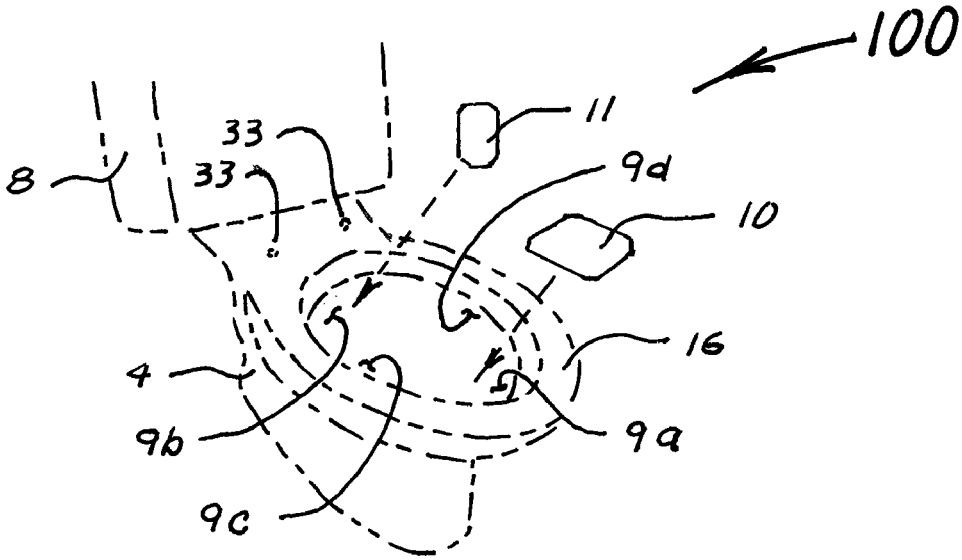
FIG. 3 is a perspective view of one embodiment of the anal-genital viewing device being placed in a toilet bowl.

In the embodiments shown in FIGS. 1-4, and in FIG. 1 specifically, the device 100 comprises a forward mirror 10 and a rear mirror 11 each respectively disposed adjacent to the front wall 9*a* and the back wall 9*b*. With the mirrors 10, 11 so disposed it can be seen in FIG. 2 that while seated on the toilet 4, the user 2 looks downward approximately along the line of sight designated as 12, through his or her separated legs 13 and 14 into the forward mirror in order to see a reflected image of his or her own anal-genital area. In other words, when the forward mirror 10 and the rear mirror 11 are angularly positioned correctly in relation to each other, in relation to the user's anal-genital region 3 and in relation to the user's eye, the line of sight 12 of the user 2 when seated on the toilet seat 15 is reflected by the forward mirror 10 to the rear mirror 11 and then to the anal-genital region 3; thus providing a view of the user's anal-genital region 3 to the user 2 that closely resembles an upward view from beneath the user's anal-genital region 3 while preserving at the same time a clear path from the anal-genital region 3 to the high water line 7 and below. Specifically the user 2 is afforded an upward-directed view of the user's anal-genital region 3 while preserving the area directly below the anal-genital region free of mirrors and other apparatus. With reference to FIG. 2 it can be seen that if the user 2 were to sit up and/or to shift to either the right or left a third-party caregiver standing generally in front of and above the toilet would have a direct line of sight to the anal-genital region of the person seated on the toilet.

There are numerous methods of disposing the mirrors 10, 11 of the device 100 in the void area 6 so as to provide a proper and in some embodiments an adjustable line of sight. In the embodiments shown in FIGS. 1-4, the forward mirror 10 is attached to the inside bowl surface area designated generally as 9*a* and the rear mirror 11 is attached to inside bowl surface area designated generally as 9*b*. On some styles or models of toilet bowls, both toilet bowl walls 9*a*, 9*b* are sufficiently close to the desired mounting angles for mirrors 10, 11 to achieve an acceptable line of sight 12 by attaching the forward mirror 10 and rear mirror 11 directly to the front wall 9*a* and the rear wall 9*b* of the toilet 4 by various permanent or semi-permanent means. Such attachment means could include for example, suction cups, liquid adhesive or double-sided adhesive tape. For reasons of cleanliness, if the mirrors are intended to be left in place permanently or semi-permanently such attachment means should present little or no obstruction to the flow of waters around the attachment means and the mirrors during toilet flushing. In all embodiments it is desirable but not essential to keep all or most of the mirrors above the static water surface 7 recognizing that water may flow over and around the mirrors when the toilet is flushed.

Figure 6:
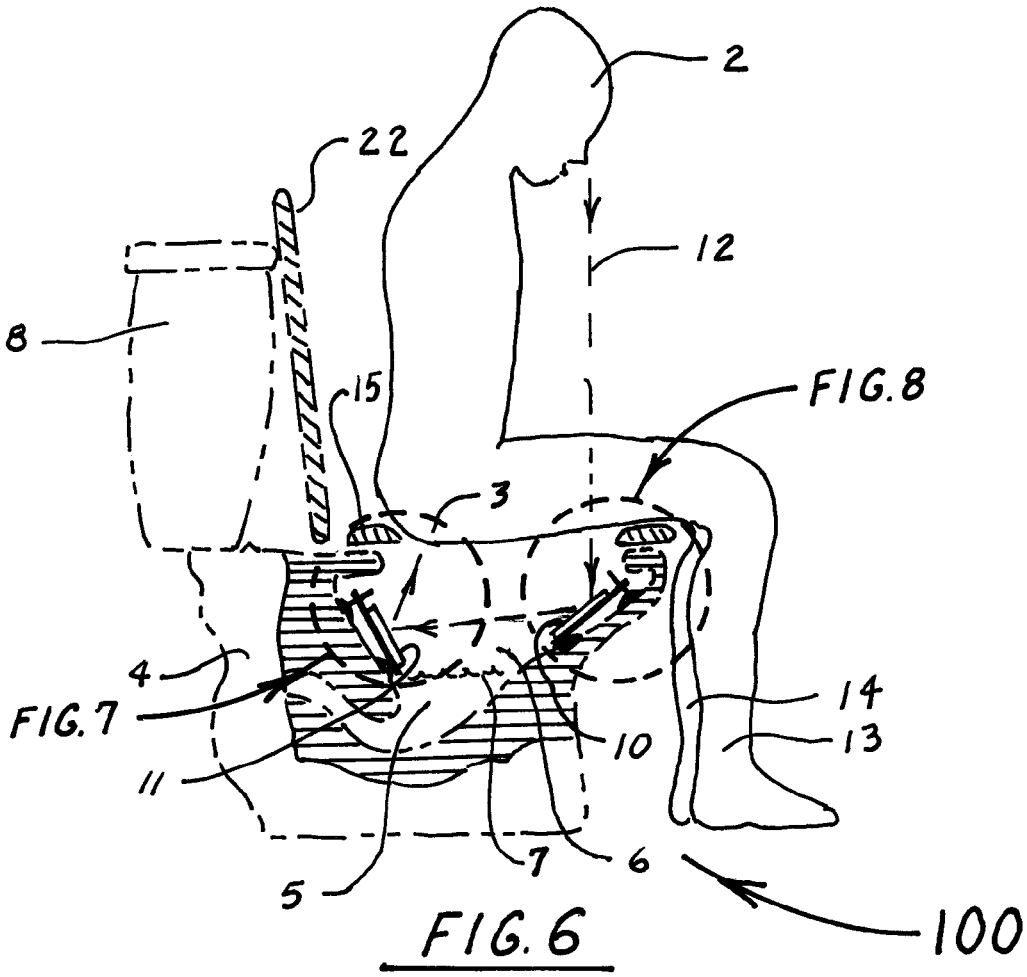
FIG. 6 is a partial sectional side elevation view of one embodiment of the anal-genital viewing device disposed in a toilet bowl and being used by a person.
Figure 7:
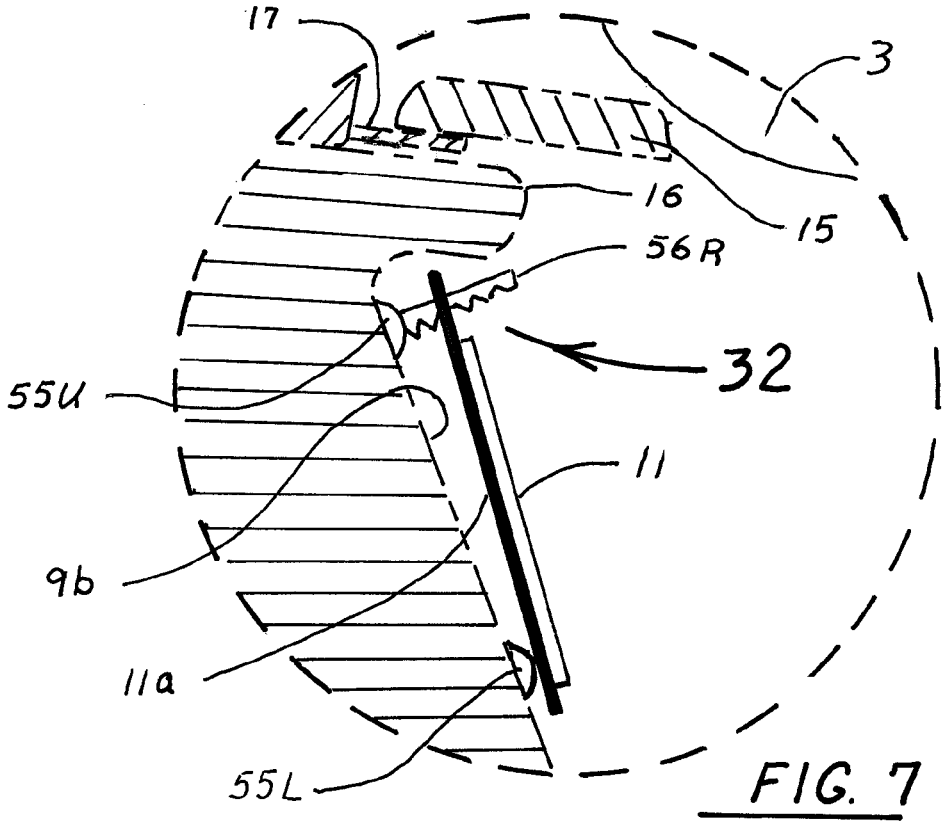
FIG. 7 is an enlarged side sectional view of the rear mirror of one embodiment of the anal-genital viewing device disposed in a toilet bowl.
Figure 8:
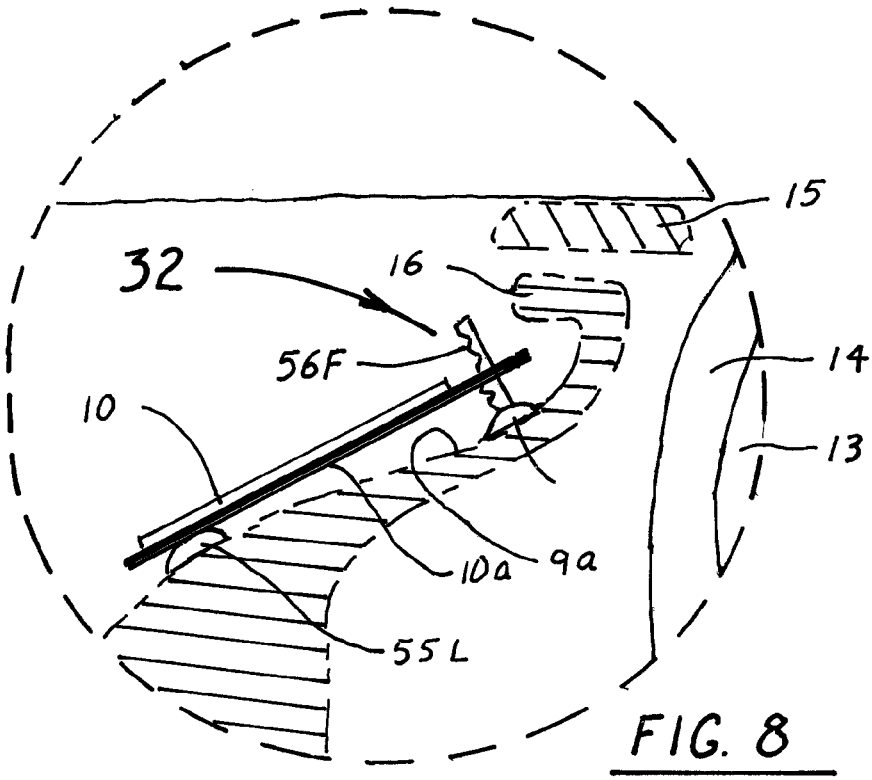
FIG. 8 is an enlarged side sectional view of the forward mirror of one embodiment of the anal-genital viewing device disposed in a toilet bowl.

In another embodiment generally shown by FIGS. 5-8, the device 100 is configured to be adjustable either for use with toilet bowls where the line of sight 12 is not acceptable or simply for the convenience of the user 2. By affording the user the ability to adjust the line of sight 12, the user can accommodate various combinations of height, weight and physical disability to obtain the most desirable line of sight 12 for a particular user's requirements. As shown by enlargement views FIGS. 7 and 8, either or both of the rear mirror 11 and forward mirror 10 may be fitted with various angle adjustment mechanisms 32 whose purpose is to allow variable adjustment of the angle of mirrors 10, 11. FIG. 7 is a side view illustrating one means of attaching rear mirror 10 to the rear wall 9*b* of the toilet bowl 4. A lower suction cup 55L adheres the rear mirror 11 to the rear wall 9*b*. In this embodiment, the rear mirror preferably comprises a rear mirror 11 attached or adhered to a rear mirror backing 11A. An upper suction cup 55U serves as a base for a rear adjustment stem 56R. The rear adjustment stem 56R passes through an opening in the rear mirror backing 11*a*. The vertical angle of the rear mirror 11 is adjusted by means of the notches in the rear adjustment stem 56R being held in place by the opening in the rear mirror backing 11*a*. FIG. 8 is a side view illustrating a similar means of attaching a forward mirror 10 to the front wall 9*b* of the toilet bowl 4. In this embodiment, the front mirror preferably comprises a front mirror 10 attached or adhered to a front mirror backing 10A. An upper suction cup 55U serves as a base for a front adjustment stem 56F. The front adjustment stem 56F passes through an opening in the front mirror backing 10*a*. The vertical angle of the front mirror 10 is adjusted by means of the notches in the front adjustment stem 56F.

The angle adjustment mechanism 32 of the forward mirror 10 and/or the rear mirror 11 permits the user 2 to select and fixate an angle of the mirror or mirrors that directs the user's line of sight 12 toward the rear mirror 11 for a variety of user seating positions, heights, weights, etc. As should be appreciated, the forward mirror 10 may also be positionally adjusted by the user 2 on the bowl surface 9*a* toward the front of the toilet bowl 4 or toward the center of toilet bowl 4 to further vary the angles of reflection of the line of sight 12.

Figure 9:
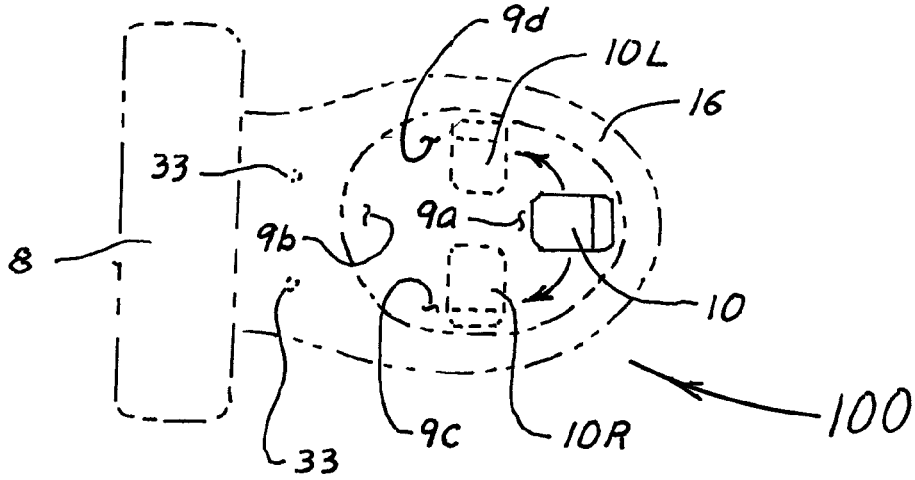
FIG. 9 is a top view of a toilet bowl illustrating the range of possible locations for placement of the forward mirror of one embodiment of the anal-genital viewing device.
Figure 10:
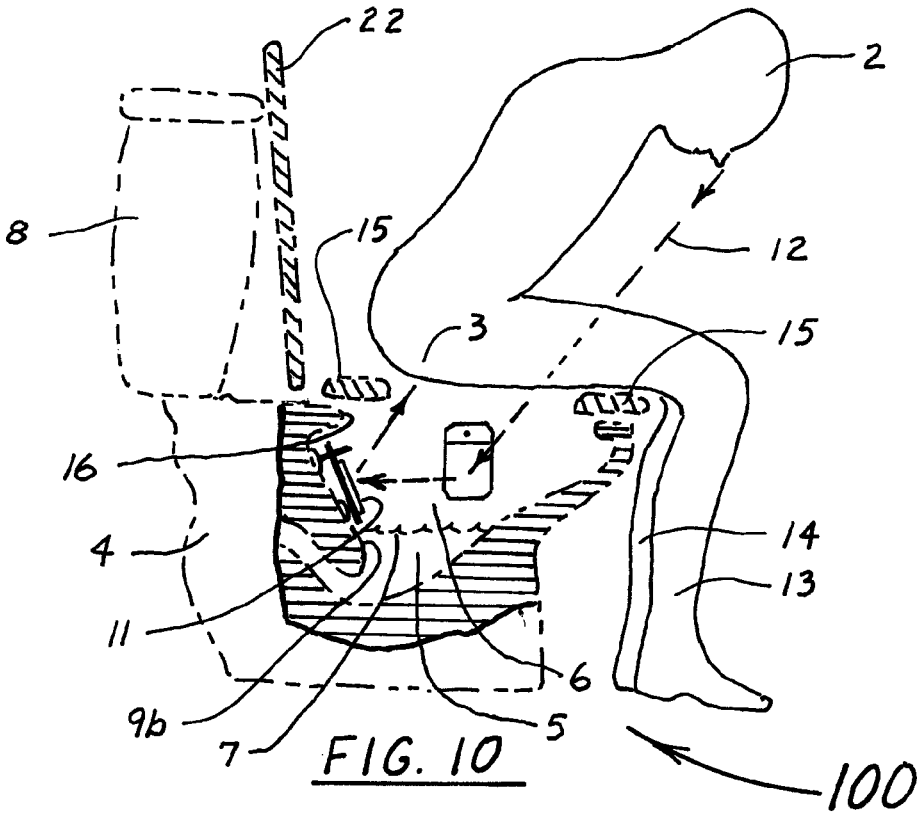
FIG. 10 is a partial sectional side elevation view illustrating the user's approximate body posture and line of sight when the forward mirror is positioned on the left face of the toilet bowl.
Figure 11:
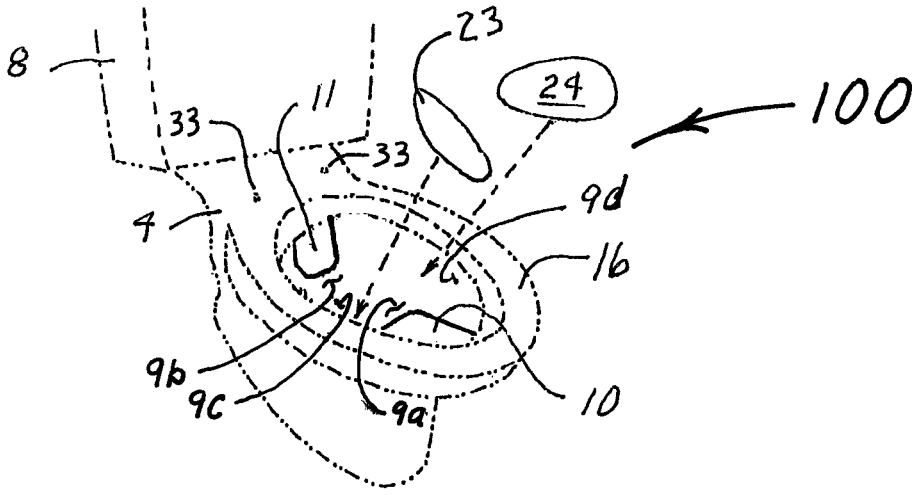
FIG. 11 is a perspective view of side mirrors of one embodiment of the anal-genital viewing device being placed in a toilet bowl.

While in most applications the forward mirror 10 will be placed adjacent to the center of the front bowl wall 9*a*, users may elect to place forward mirror 10 adjacent to the bowl wall 9*a*, 9*c*, or 9*d* of the toilet 4 along any point of the interior surface 9*a*, 9*c*, 9*d* within the front portion of the toilet bowl between locations 10R and 10L as shown in FIG. 9. FIG. 10 illustrates a user's 2 body posture and approximate line of sight 12 when forward mirror 10 is positioned at the extreme left position denoted as 10L. Mounting positions of the forward mirror 10 other than at the center front of the toilet bowl wall 9*a* may be desirable to the user 2 when the normal line of sight 12 as shown in FIG. 2 or 6, for example, is obstructed by the user's 2 hands or by a medicine delivery device.

In another embodiment shown generally in FIGS. 11-14, additional lines of sight 12 may be achieved while at the same time preserving the line of sight afforded by placing the front mirror 10 adjacent the front wall 9*a* by the use of additional mirrors placed adjacent 9*c* and/or 9*d* or anywhere adjacent the wall between locations 10R and 10L shown on FIG. 10. For example, rather than moving the forward mirror 10 from the center of the front wall 9*a* of the toilet 4, the device 100 could include additional left mirror 24 and/or right mirror 23 disposed adjacent to the left 9*d* and/or right wall 9*c* of the toilet 4. The left mirror 24 and the right mirror 23 are respectively positioned on the left wall 9*d* and right wall 9*c* of the toilet 4 such that the viewer's 2 line of sight is reflected off either side mirror and then off the rear mirror 11 to offer alternate perspective views of the anal-genital region 3. As was the case above with alternate locations of the forward mirror 10, these additional views are particularly useful to the person 2 when the view afforded by the forward mirror 10/rear mirror 11 as described above is blocked by the person's hands or by use of a medicine delivery device and yet still retains the line of sight of the forward mirror 10/rear mirror 11 combination. Although the left mirror 24 and right mirror 23 in this embodiment may be of almost any shape, the preferred shape is a teardrop shape which best matches the multi-curved shapes of the side walls of most toilet bowls. A teardrop shape maximizes perimeter contact of the single-plane mirror with the multi-curved inside surfaces of the toilet bowl and thereby simplifies attachment as well as minimizing obstruction to the flow of flush waters. The left mirror and the right mirror may attach directly to the inside surfaces of the toilet bowl by various means as described herein. An embodiment using multiple mirrors, particularly multiple mirrors between the locations designated as 10R and 10L in FIG. 10, is especially useful where a third-party caregiver desires a line of sight to the anal-genital region of the person seated on the toilet 4. Although such an embodiment could include two forward mirrors placed anywhere along the positions between 10R and 10L, for best viewing concurrently by the third-party caregiver and the user 2, there is a front mirror 10 placed at 9*a* adjacent the center front of the bowl 4 and a side mirror 24 or 23 placed at either location 10R or 10L. This arrangement would provide two lines of sight 12 sufficiently separated to allow for easy concurrent viewing both by the user 2 and a third-party caregiver. For example, the caregiver could take a position generally in front of and above the bowl and have a line of sight from the front mirror 10 to the rear mirror 11 to the anal-genital region of the user 2 while the user could lean either to the left or right and have line of sight from either or both side mirrors 23, 24 to the rear mirror 11 to the anal-genital region of the user 2, thus keeping each of the viewers' heads a comfortable distance apart.

The mirrors may be attached to the bowl surfaces permanently, semi-permanently or temporarily by means such as but not limited to epoxies, glues, double sided adhesive tapes, calking, suction cups, a wide assortment of mechanical devices, magnets or bolts through holes drilled in the toilet bowl shell. Alternatively, the mirrors could be embedded in the toilet bowl walls at time of manufacture according to the invention. Some portion of the forward mirror 10 or the rear mirror 11 or both and/or the optional side mirrors 23, 24 may be disposed below the high water line 7. Numerous other means of disposing the mirrors 10, 11, 23, 24 of the invention adjacent to the interior bowl surfaces and other means of angularly adjusting the mirrors 10, 11, 23, 24 could be developed by a person skilled in the art without straying from the intended scope and field of the invention described herein. For example, mirrors 10, 11, 23, 24 of the invention could be supported within the toilet bowl cavity 6 in accordance with the invention by means of U-shaped clips fitted over the bowl rim 16 to which the desired mirrors are attached, by tab extensions friction-fit into slotted receivers adhered to the top surface of bowl rim 16, or by other means developed by a person skilled in the art.

The mirrors can be constructed of mirrored glass on a rigid backing material, mirrored glass with a shatter-proof backing material, mirrored plexiglass material or other suitable materials or combinations of materials that provide an adequate coefficient of reflection, durability and user safety. The rear mirror 11 or front mirror 10 may use a concave reflective surface to produce magnified images of the anal-genital area.

Figure 4:
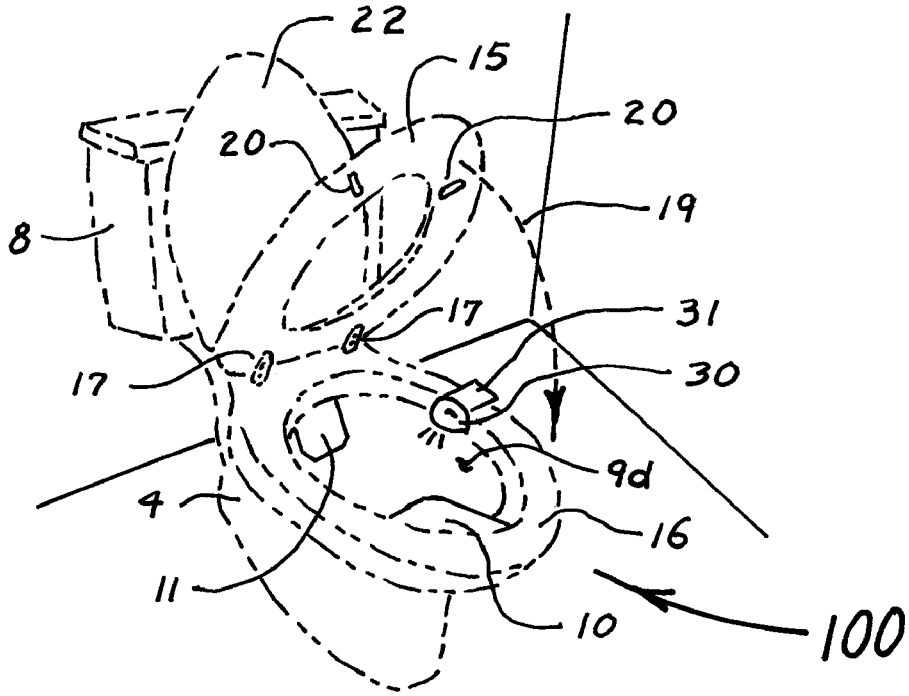
FIG. 4 is a perspective view of the anal-genital viewing device disposed in a toilet bowl with the toilet seat being rotated toward the toilet bowl rim.
Figure 5:
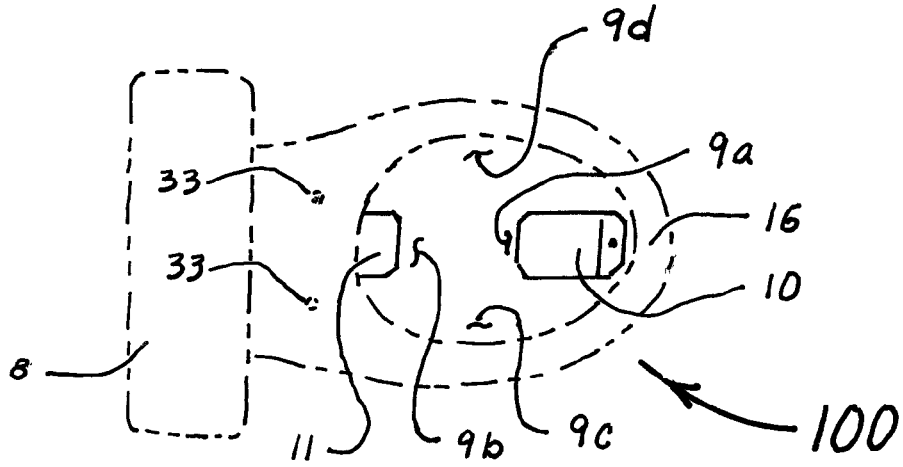
FIG. 5 is a top view of one embodiment of the anal-genital viewing device disposed in a toilet bowl.
Figure 12:
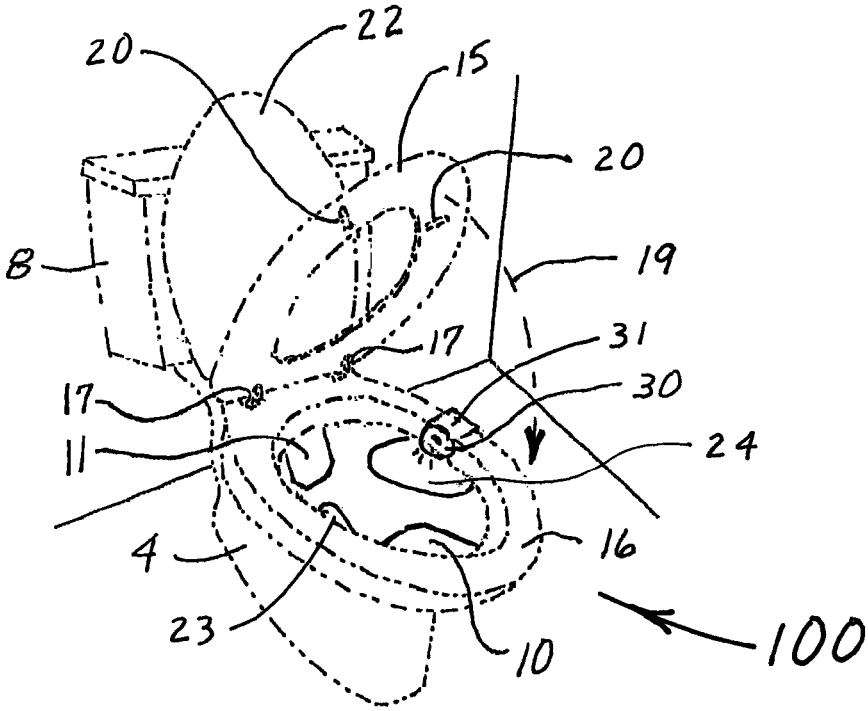
FIG. 12 is a perspective view of one embodiment of the anal-genital viewing device disposed in a toilet bowl with the toilet seat being rotated toward the toilet bowl rim.
Figure 13:
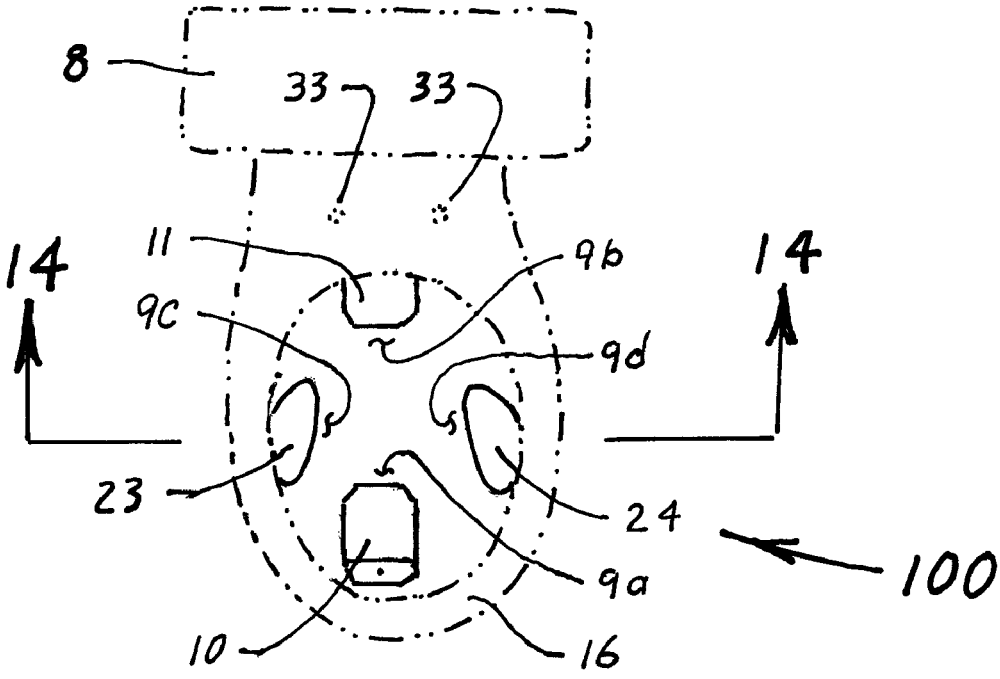
FIG. 13 is a top view of one embodiment of the anal-genital viewing device disposed in a toilet bowl.
Figure 14:
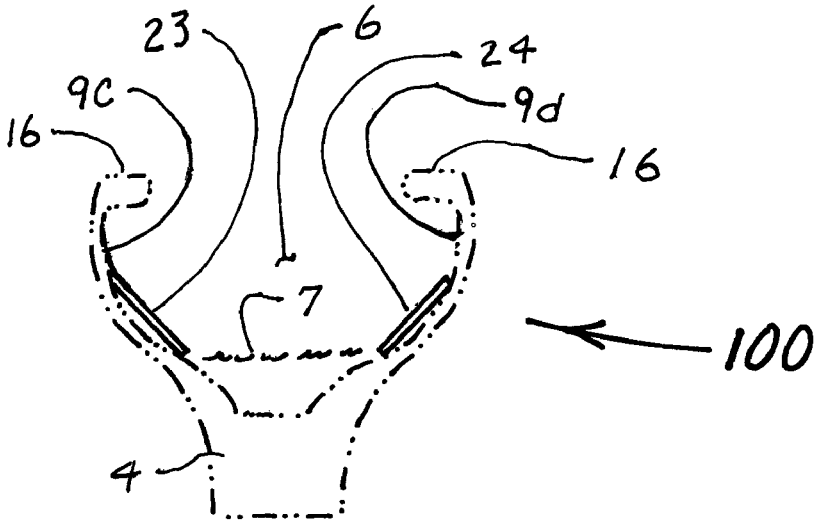
FIG. 14 is a front sectional view of one embodiment of the anal-genital viewing device showing placement of the side mirrors within a toilet bowl.
Figure 16:
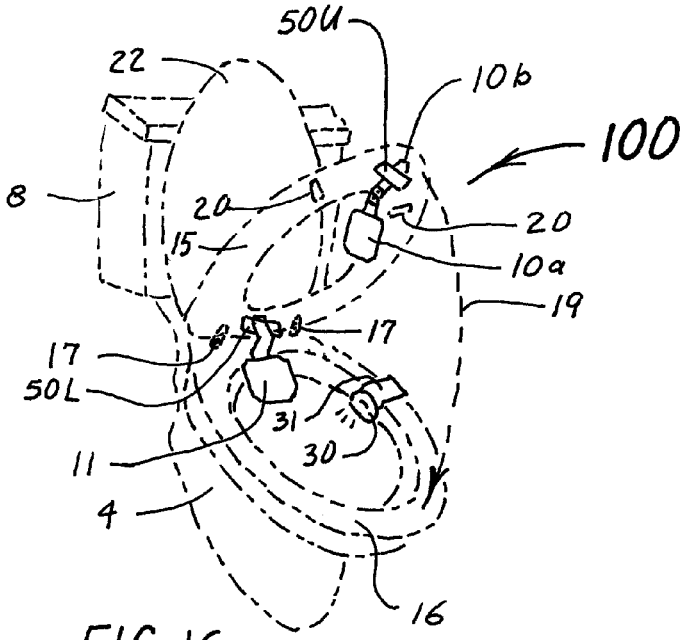
FIG. 16 is a perspective view of one embodiment of the anal-genital viewing device attached to the underside of a toilet seat and with the toilet seat being rotated toward the toilet bowl rim.
Figure 17:
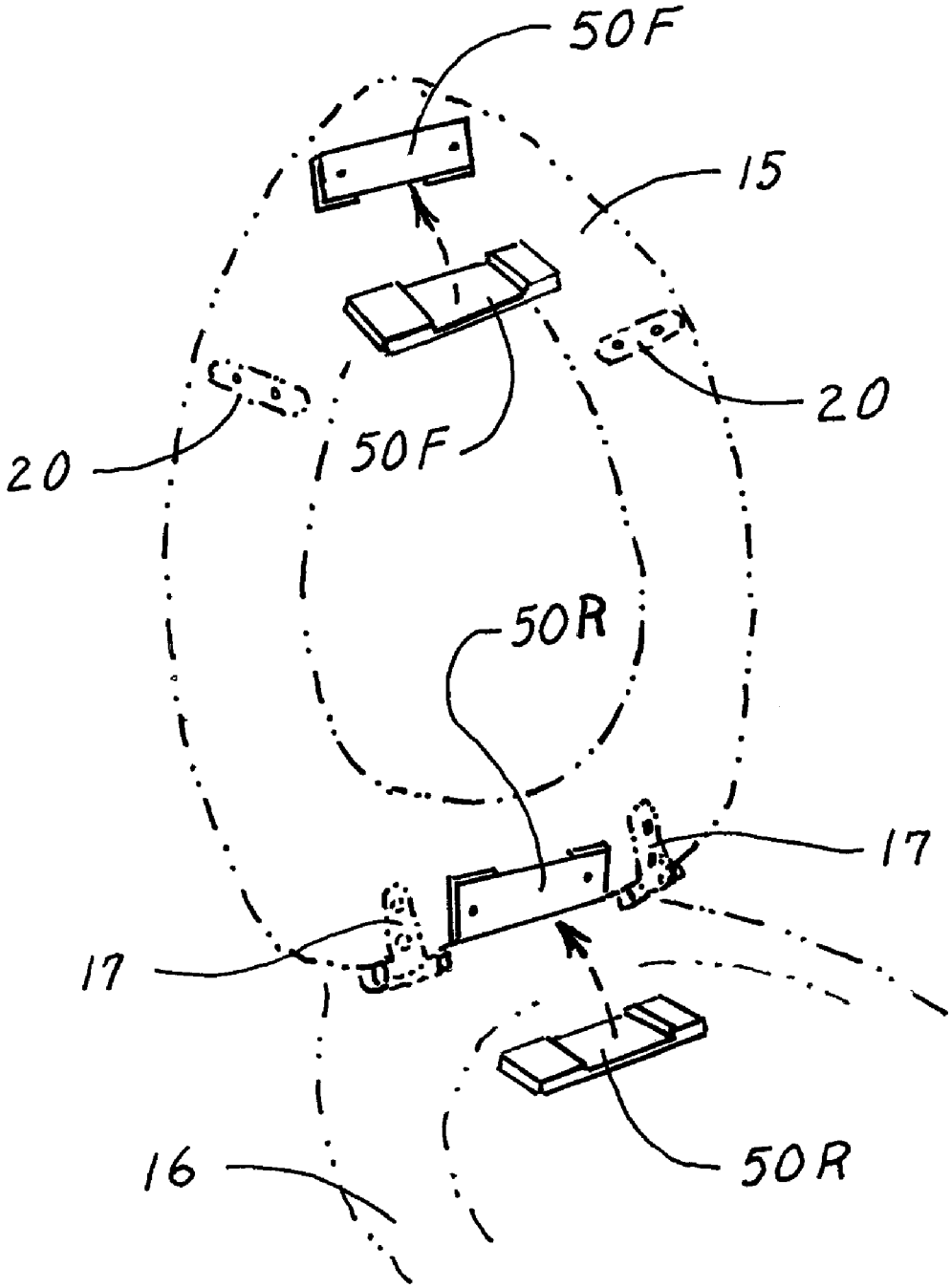
FIG. 17 is a perspective view illustrating placement of slotted receivers on the front underside and on the rear underside of a toilet seat.
Figure 18:
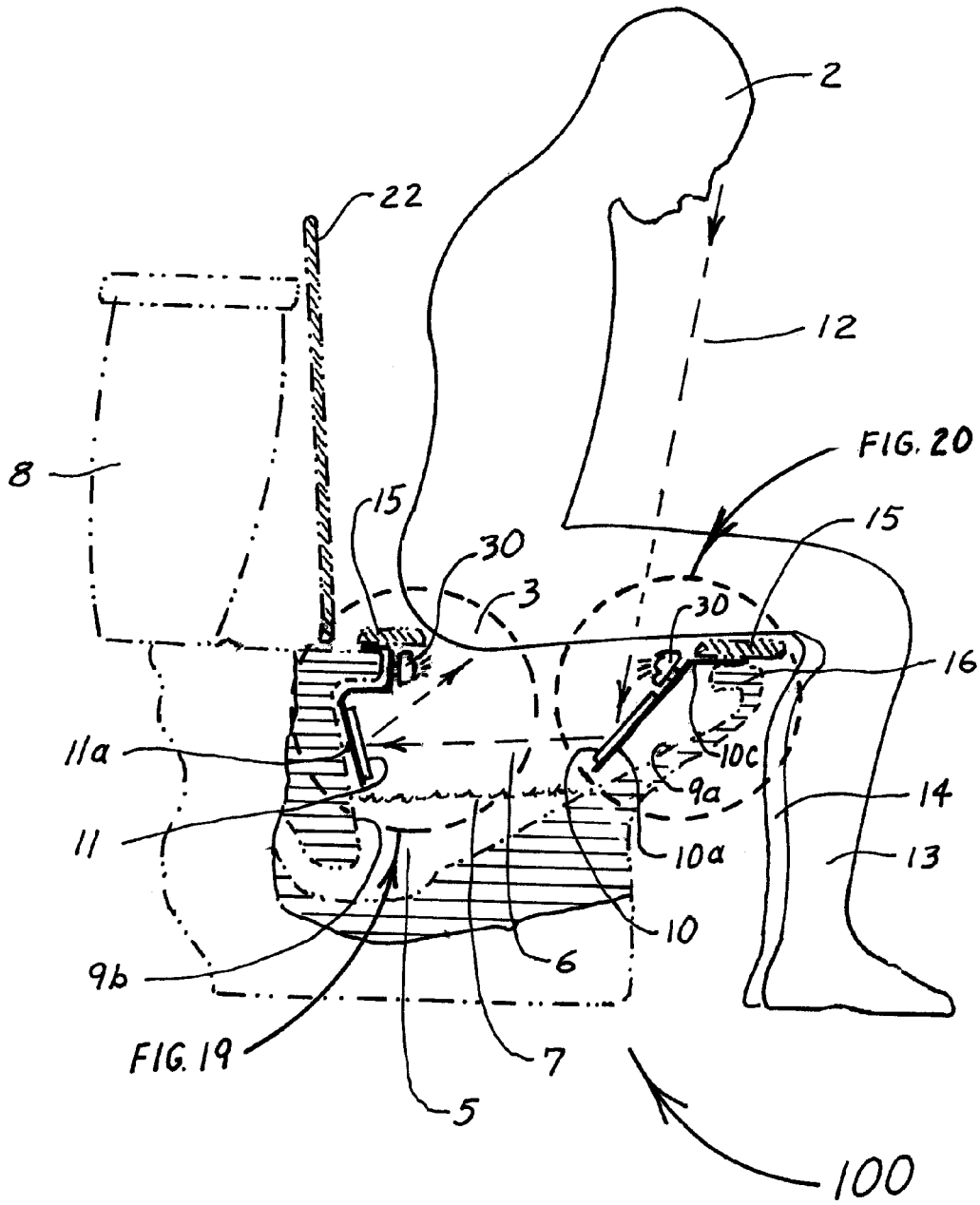
FIG. 18 is a partial sectional side elevation view of one embodiment of the anal-genital viewing device disposed in a toilet bowl and being used by a person.

Most users will prefer to use at least one illumination device 30 disposed within the bowl of the toilet 4. FIGS. 4, 12 and 16 show one example of such an illumination device 30 comprised of a battery powered light source 30 attached to a generally U-shaped rim clip 31 designed to be placed over the bowl rim 16. One such device is powered by three AAA batteries in series, has five standard LED bulbs and attaches magnetically to a flat metal U-shaped rim clip 31 shaped to fit over a toilet bowl rim 16. The magnetic means of attachment to the metal rim clip 31 allows rotation of the light source 30 to point the light directionally as the user 2 prefers. Most users 2 will elect to employ two or more of the illumination devices 30, especially those monitoring disease conditions. Other illumination alternatives will be discussed in connection with the various embodiments described below with which they are most appropriately used. A person skilled in the art could develop numerous other means of providing illumination to the inside of the toilet bowl cavity 6 generally and/or to the user's 2 anal-genital region 3 specifically in accordance with the invention.

The mirrors of the anal-genital self-viewing device 100 may be disposed in various manners so as to provide the user with easy and convenient manners of placing the device 100 within in a toilet bowl 4 so as to achieve the proper line of sight 12. In one embodiment, shown in FIGS. 15-20, the forward mirror 10 and the rear mirror 11 are equipped with mirror backing projection tongues 10*b*, 11*b* which are designed to mate via a friction fit with slotted receives 50F, 50R which are attached to the underside of the toilet seat 15. The mirrors 10, 11 may be removably attached to the slotted receivers 50F, 50R and thus to the underside of the toilet seat 15. The slotted receivers may then be left mounted to the underside of the toilet seat 15 on a permanent or semi-permanent basis and the mirrors may then be installed and removed on an as-needed basis.

In FIGS. 15-20, the slotted receivers 50F, 50R are shown attached to the front and rear portions of the underside of seat 15 so that a front mirror 10 and a rear mirror 11 may be attached. However, slotted receivers could be placed anywhere on the underside of the seat 15 in such a way so as to be able to affix any combination of mirrors desired—front 10, rear 11, right 23 or left 24 or a single rear mirror 11 and a single front mirror 10 whereby the front mirror could be placed at any location between 10R and 10L as shown in FIG. 9. The slotted receivers could also be placed in corresponding locations on the rim 16 or the top surface of the toilet seat 15, in such a manner so as to provide the proper line of sight 12. The slotted receivers 50F, 50U may be attached to the toilet seat 15 or to the rim 16 by means of screws, adhesive tape, double-sided adhesive tape, reusable connectors, glue, epoxy or other suitable means.

Figure 15:
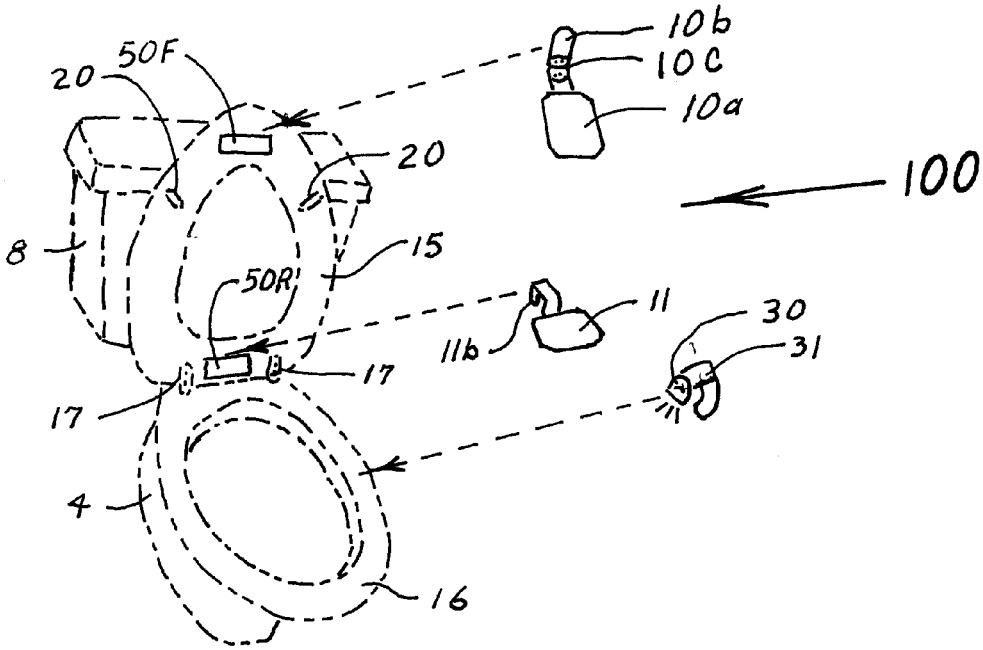
FIG. 15 is a perspective view of one embodiment of the anal-genital viewing device being attached to the underside of a toilet seat.
Figure 19:
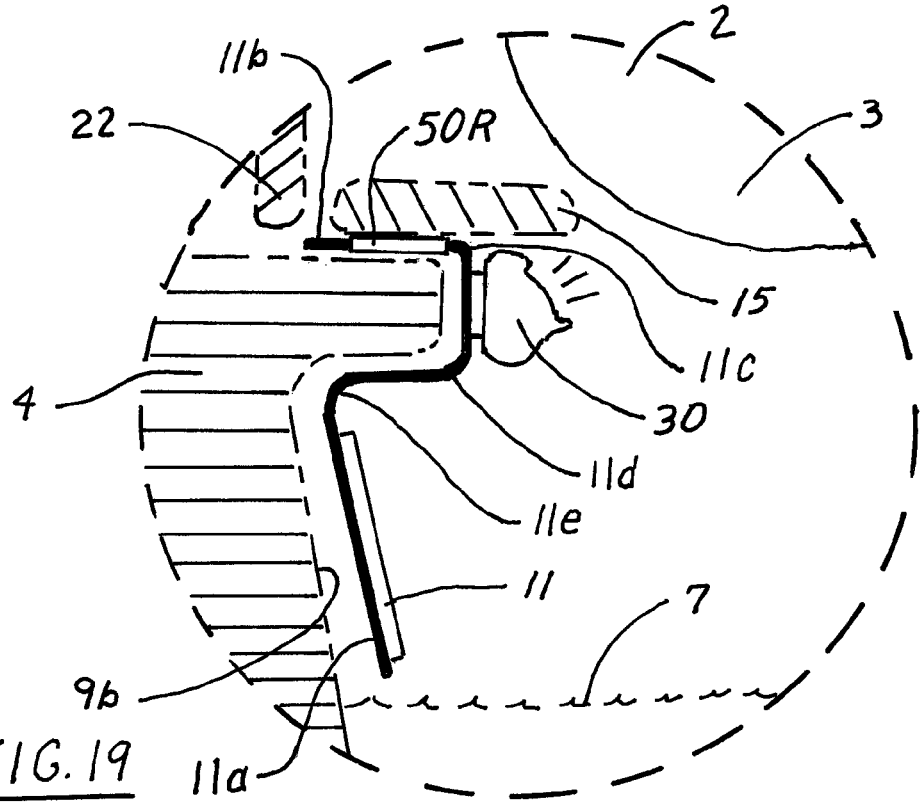
FIG. 19 is an enlarged side sectional view of the rear mirror of one embodiment of the anal-genital viewing device disposed in a toilet bowl.
Figure 20:
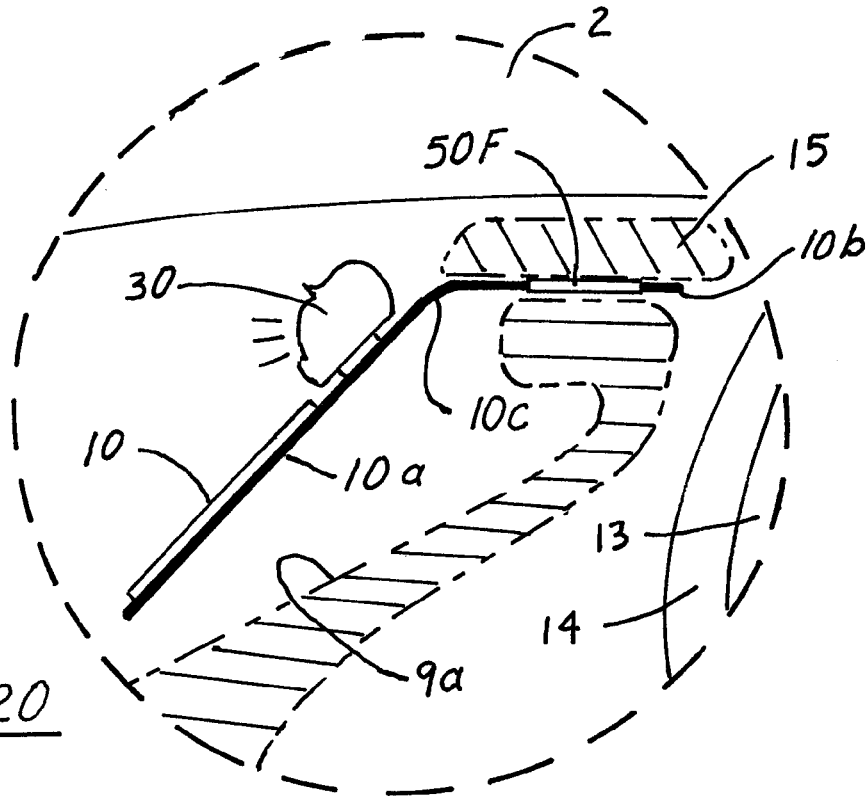
FIG. 20 is an enlarged side sectional view of the forward mirror of one embodiment of the anal-genital viewing device disposed in a toilet bowl.

FIG. 15 shows mirrors 10, 11 being placed into friction-fit slotted receivers 50F, 50R located at the front and rear portions of the underside of toilet seat 15 or wherever mirrors are desired to be located. FIG. 16 illustrates rotation of the toilet seat 15 partway between the bowl rim 16 and the water storage tank 8 with mirrors 10, 11 attached to the underside of seat 15 after being inserted into the slotted receivers 50F, 50R. It can be seen in FIG. 18 that when toilet seat 15 is lowered to the bowl rim 16 the device 100 is positioned such that a user 2 while seated on the toilet seat 15, may look downward approximately along the line of sight 12 through separated legs into the forward mirror 10 to see a reflected image of his or her anal-genital region. With reference to FIGS. 19 and 20, side views of the rear mirror 11 and the front mirror 10 of the device 100 are shown with the seat 15 fully lowered to the rim. With continuing reference to FIG. 19, the rear mirror 11 is shown attached to a bendable metal rear mirror backing 11*a* which ends in a rear mirror backing projection tongue 11*b* configured to frictionally fit into the rear slotted receiver 50R. If bendable metal or other similarly malleable, non-rebound material is used, the rear mirror backing projection tongue 11*b* may contain bends 11*c*, 11*d*, 11*e* so as to properly angle rear mirror 11 so as to achieve the proper line of sight 12. With reference to FIG. 20, the front mirror 10 is shown attached to a bendable metal front mirror backing 10*a* that ends in a front mirror backing projection tongue 10*b* configured to frictionally fit into the front slotted receiver 50F. If bendable metal is used, the front mirror backing projection tongue 10*b* may contain a bend 10*c* so as to properly angle front mirror 10 so as to achieve the proper line of sight 12. It should be noted that there are numerous locations and numbers of bends 10*c*, 11*c*, 11*d*, 11*e* that could be used with respect to the rear and front mirror backing projection tongues 11*b*, 10*b* to achieve the proper line of sight 12. In various embodiments, the bends may be permanent or, preferably, the metal is soft enough so as to be adjustable by the user. In other embodiments, the front and rear mirror backing projection tongues 10*b*, 11*b* may comprise a number of lengths joined by adjustable hinges, pivots, swivels, gooseneck tubing and the like may be used in place of bends 10*c*, 11*c*, 11*d*, 11*e* to adjust the front and rear mirrors 10, 11 for proper line of sight 12. In one embodiment, particularly suited to concurrent viewing by a caregiver and a person seated on the toilet, but also useful for self-viewing alone or by a caregiver alone, the mirror backings of the side mirrors 23, 24 may also end in projection tongues comprising a number of lengths joined by adjustable hinges, pivots, swivels and the like in place of bends to adjust the side mirrors 23, 24 for proper line of sight 12 in all directions—including front-to-back and side-to-side. An omni-directional swivel joint or gooseneck tubing may be used in place of hinges or other type joints to provide simple and complete omni-directional adjustability.

As can be seen in FIG. 16 this embodiment may be used with a light source(s) 30 attached to a U-shaped clip 31 designed to go over the rim 16. If metal is used for or as part of the mirror backings 11*a*, 10*a*, a light source(s) 30 may be magnetically attached to the front and/or mirror backings 11*a*, 10*a* as is shown in FIGS. 19 and 20.

The slotted receiver and docking flange means for attaching the mirrors to the underside of the seat 15 is just one manner of disposing the mirrors into the toilet bowl 4 so as to create the proper line of sight 12. However a wide variety of attachment means may be used to removably attach the mirrors to the underside of toilet seat 15 or to the rim 16, including but not limited to hook and loop fasteners (trade name Velcro), magnets, embedded bolts and wing nuts, keyhole-shaped slots and flared bolt heads and frictional twist latch devices. It is desirable that the attachment means provide a firm, solid connection to the toilet seat underside or to the toilet rim to resist dislodgment during activities such as raising or lowering of the toilet seat and while the user is manually adjusting mirror angles.

Figure 19A:
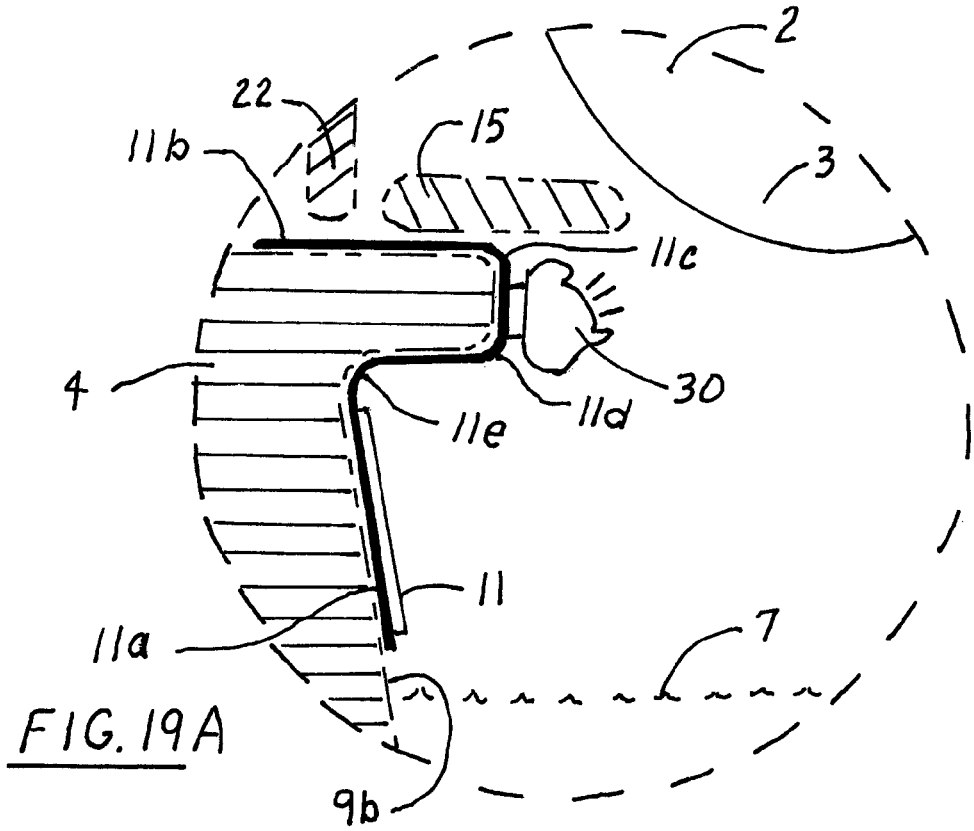
FIG. 19A is an enlarged side sectional view of the rear mirror of one embodiment of the anal-genital viewing device disposed in a toilet bowl.
Figure 20A:
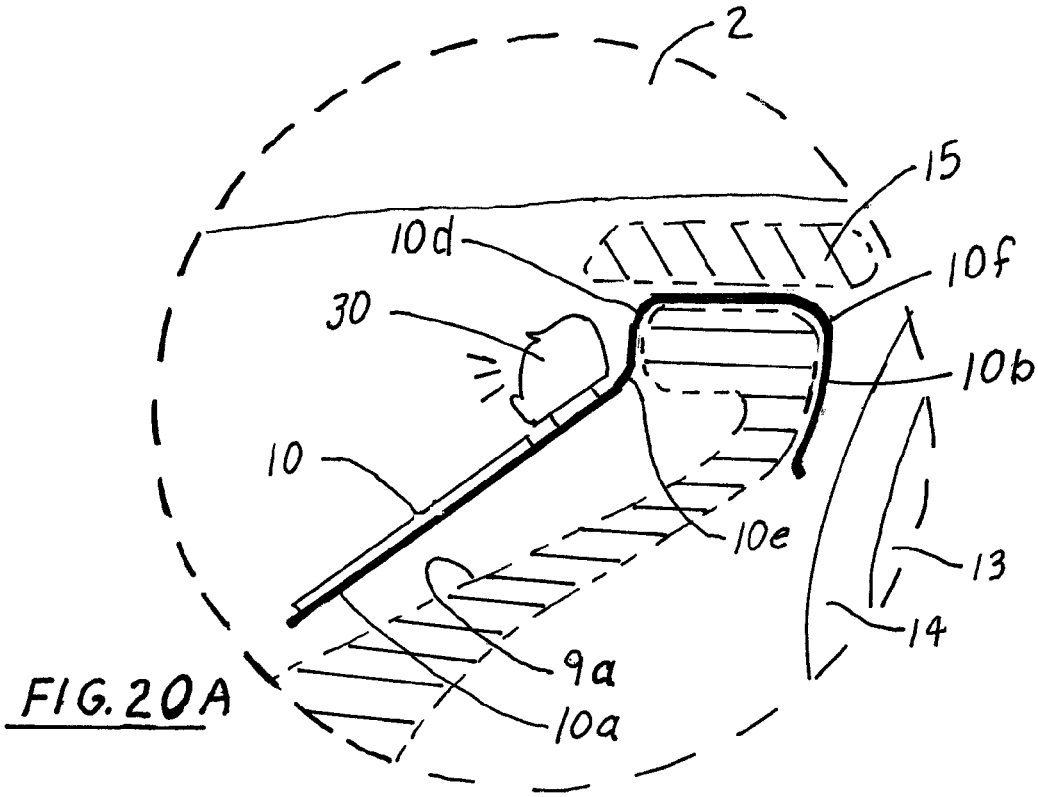
FIG. 20A is an enlarged side sectional view of the front mirror of one embodiment of the anal-genital viewing device disposed in a toilet bowl.

In one embodiment the mirror backings 10*a*, 11*a* and the mirror backing projection tongues 10*b*, 11*b* could be bent into hanger clips in the shape of an inverted U that simply hangs over the rim 16 or over the top surface of the toilet seat 15 similar to the U-shaped clip 31 used to hang the light source 30. The mirrors could then be placed anywhere around the bowl so as to achieve the desired line of sight 12 and would be easily removable by the user. One embodiment of a generally U-shaped configuration that is slightly more complex than a simple hanger clip 31 that is easy to attach and remove yet provides a firm solid connection to the rim 16 or seat 15 is shown in FIGS. 19A and 20A. With reference to FIG. 19A, the rear mirror backing projection tongue 11*b* extends from the rear mirror backing 11*a* generally up and around the rear wall 9*b* of the toilet 4 via bends 11*e*, 11*d* and 11*c* to rest on and be supported between the rim 16 and the seat 15. The rear mirror backing projection tongue 11*b* is preferably made of a malleable metal or other similar material so as to be able to be bent to configure to a wide variety of bowl/rim shapes and configurations. In some embodiments, the rear mirror backing projection tongue can be slid under and secured by the hinges 17. In other embodiments the rear mirror backing projection tongue 11*b* may wrap up over and around the seat 15 or can merely rest on the surface of the rim 16. With reference to FIG. 20A, the forward mirror backing projection tongue 10*b* extends from the forward mirror backing 10*a* up to and over rim 16 via bends 10*d*, 10*e* and 10*f* to rest on and be supported between the rim 16 and the seat 15. In other embodiments, the forward mirror backing projection tongue 10*b* can wrap up over and around seat 15 or can merely rest on the surface of the rim 16. The front mirror backing projection tongue 10*b* is preferably made of a malleable metal or other similar material so as to be able to be bent to configure to a wide variety of bowl/rim shapes and configurations. FIG. 19A and FIG. 20A are conceptually representative of and inconclusive of all various designs that use clips, or other devices that functionally serve the purposes of clips, over the seat 15 or over the rim 16 to serve as supports for forward mirror 10, rear mirror 11 and/or side mirrors 23, 24.

The embodiments shown in FIGS. 15-20 and discussed with reference thereto afford several advantages. Firstly, some users will find it more desirable to install mirrors 10, 11 on the underside of raised toilet seat 15, on the rim 16 or to hang the mirrors form the seat 15 than to install mirrors 10, 11 inside the toilet bowl as in the embodiments of FIGS. 1-14. Secondly, mirrors 10, 11 of this embodiment may be extracted from the interior of toilet bowl cavity 6 prior to flushing the toilet or prior to use of the toilet as a urinal by simply rotating toilet seat 15 upward to its resting position leaning against the water storage tank 8 or by removing the mirrors hanging by clips on the rim or seat.

Figure 21:
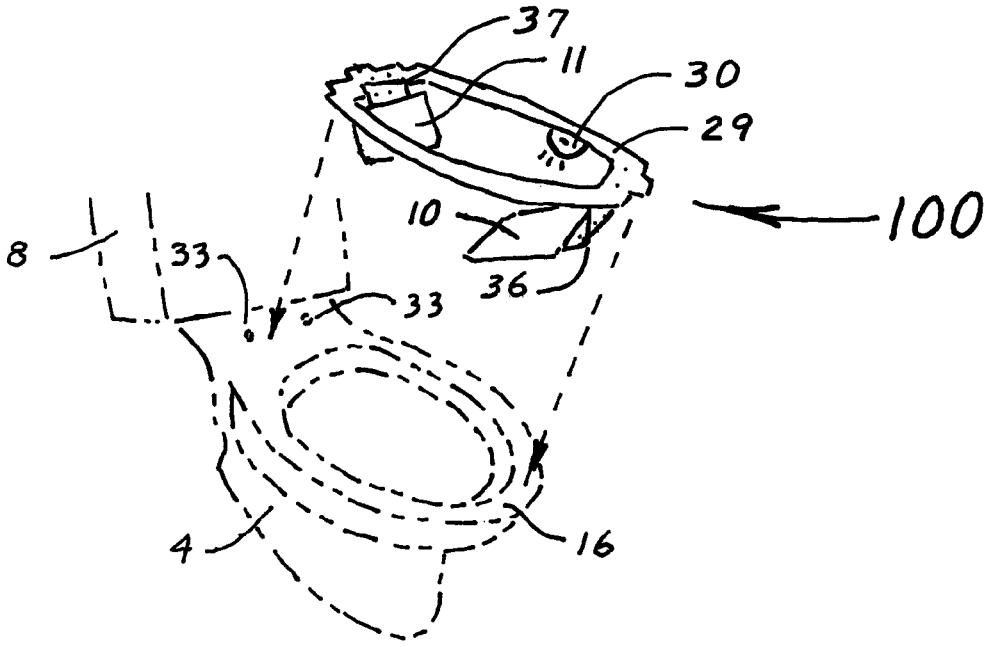
FIG. 21 is a perspective view of one embodiment of the anal-genital viewing device being placed in a toilet bowl.
Figure 22:
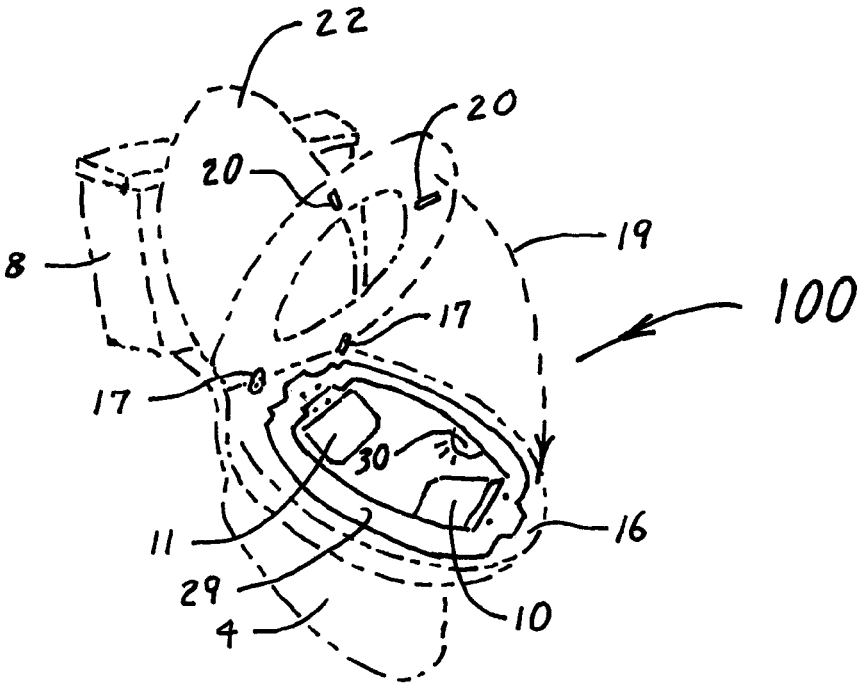
FIG. 22 is a perspective view of one embodiment of the anal-genital viewing device disposed in a toilet bowl and with the toilet seat being rotated toward the toilet bowl rim.

Other embodiments that may have some of these same advantages are shown in FIGS. 21-25. In these embodiments of the anal-genital self-viewing device 100 a forward mirror 10 and a rear mirror 11 are attached to a frame 29. As shown in FIGS. 21-22, the frame 29 is preferably thin and flat so as to rest on the rim 16 of the toilet bowl 4 beneath the toilet seat 15. In some embodiments (FIGS. 21-22), the frame 29 is secured in place on the rim 16 by the lowered toilet seat 15. In other embodiments (FIGS. 23-24), discussed below in more detail, the frame 29 may be attached directly to the underside of the toilet seat 15 either permanently or preferably by means which permit ease of attachment to the underside of the toilet seat and ease of removal from the toilet seat 15.

Figure 23:
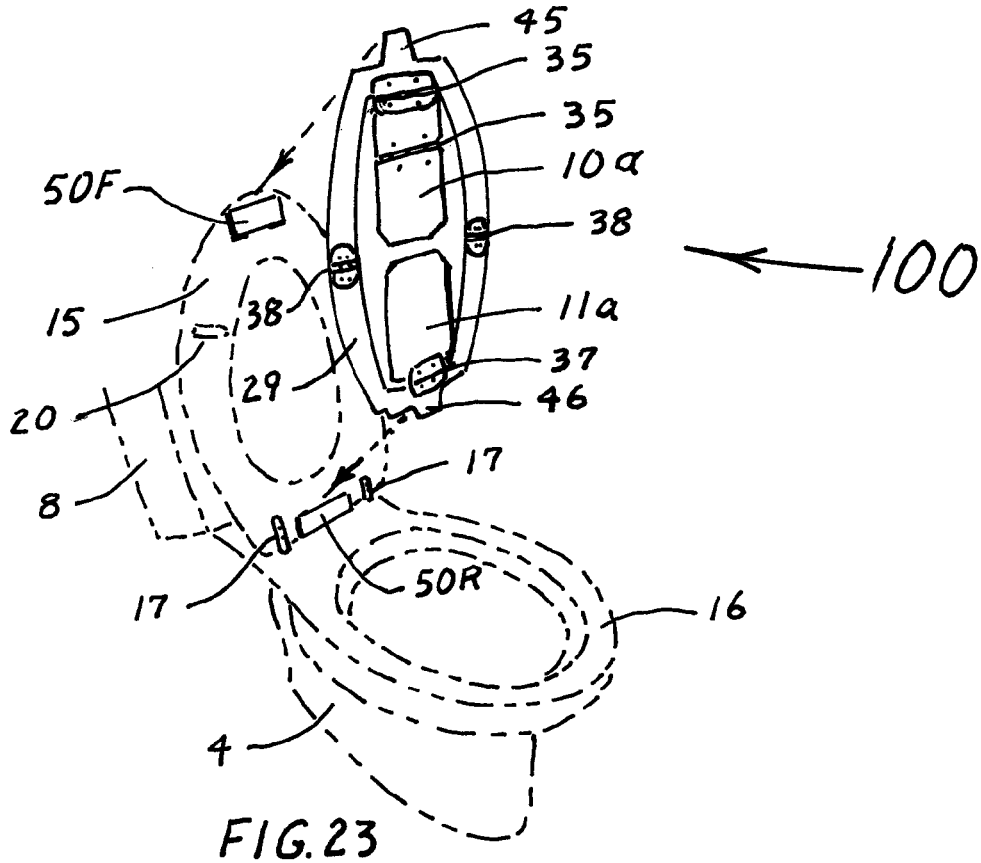
FIG. 23 is a perspective view of one embodiment of the anal-genital viewing device being attached to the underside of a toilet seat with forward mirror and rear mirror folded into the plane of a flat frame, illustrating that the embodiment of FIGS. 21, 22 may be attached to the toilet seat underside.
Figure 24:
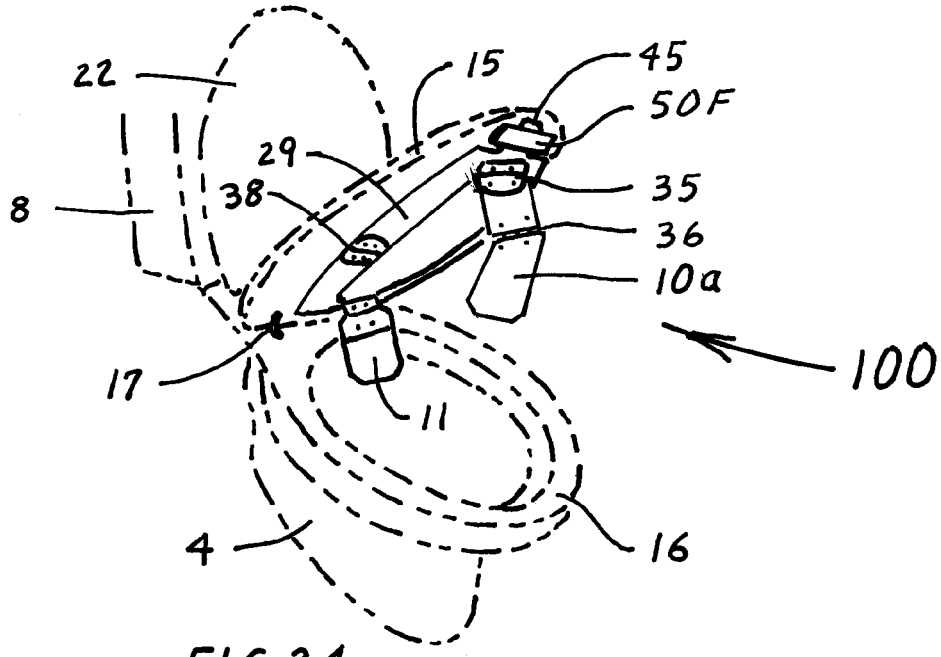
FIG. 24 is a perspective view of one embodiment attached to the underside of a toilet seat with forward mirror and rear mirror rotated downward out of the plane of the flat frame and with the toilet seat being rotated toward the toilet bowl rim.
Figure 25:
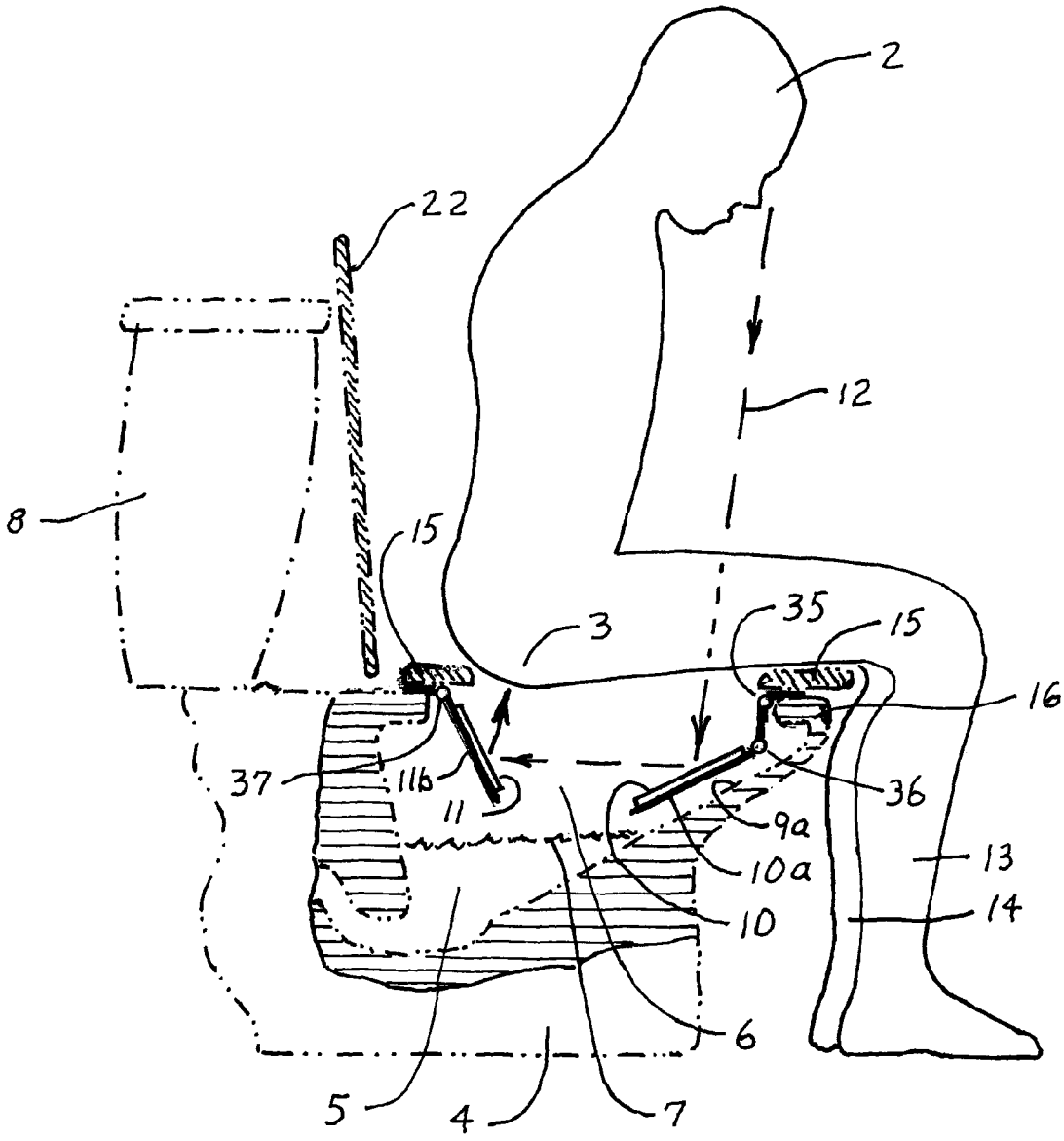
FIG. 25 is a partial sectional side view of one embodiment of the anal-genital viewing device disposed in a toilet bowl and being used by a person.
Figure 26:
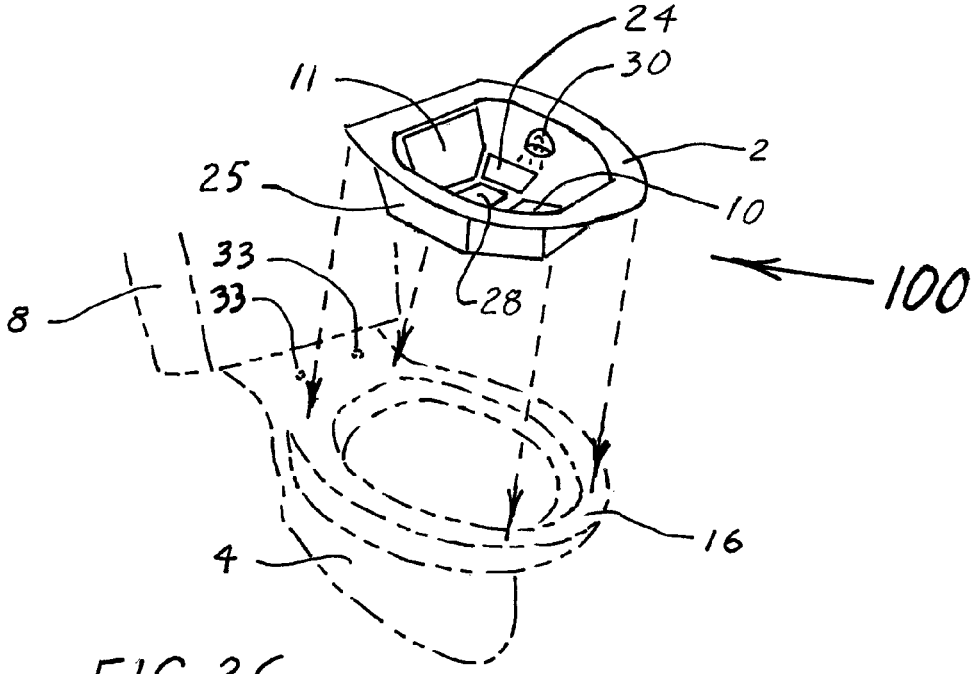
FIG. 26 is a perspective view of one embodiment of the anal-genital viewing device being placed in a toilet bowl.
Figure 27:
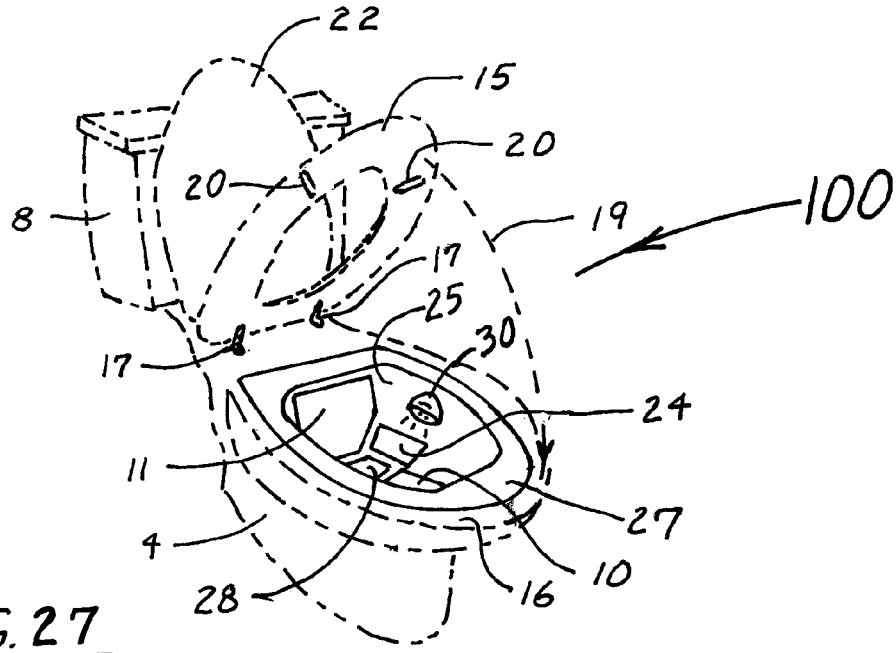
FIG. 27 is a perspective view of one embodiment of the anal-genital viewing device disposed in a toilet bowl and with the toilet seat being rotated toward the toilet bowl rim.
Figure 28:
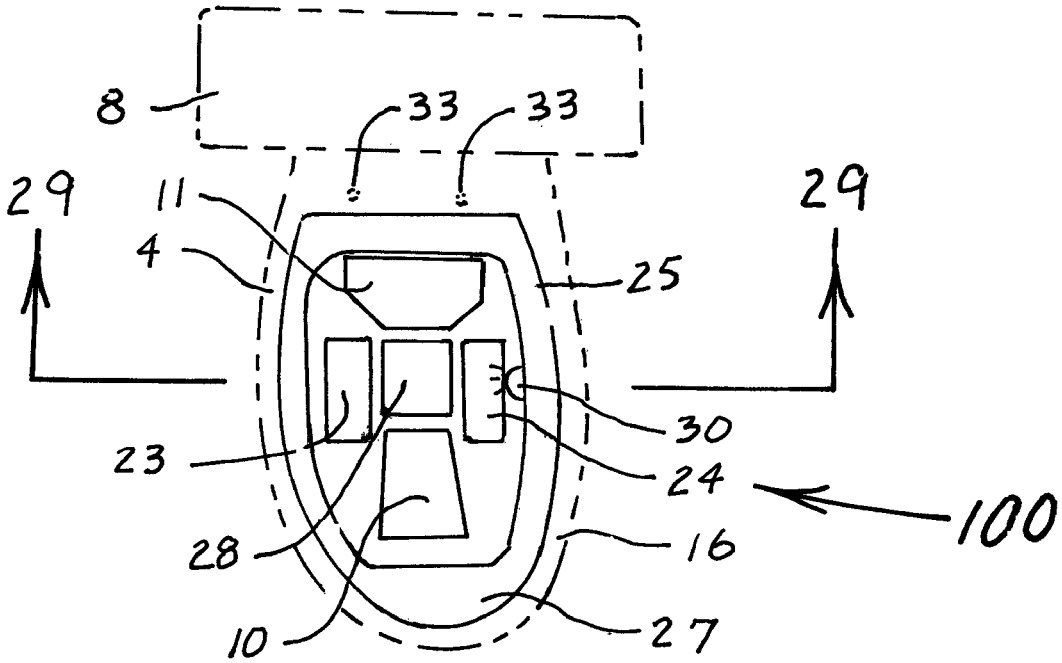
FIG. 28 is a top view of one embodiment of the anal-genital viewing device disposed in a toilet bowl.
Figure 29:
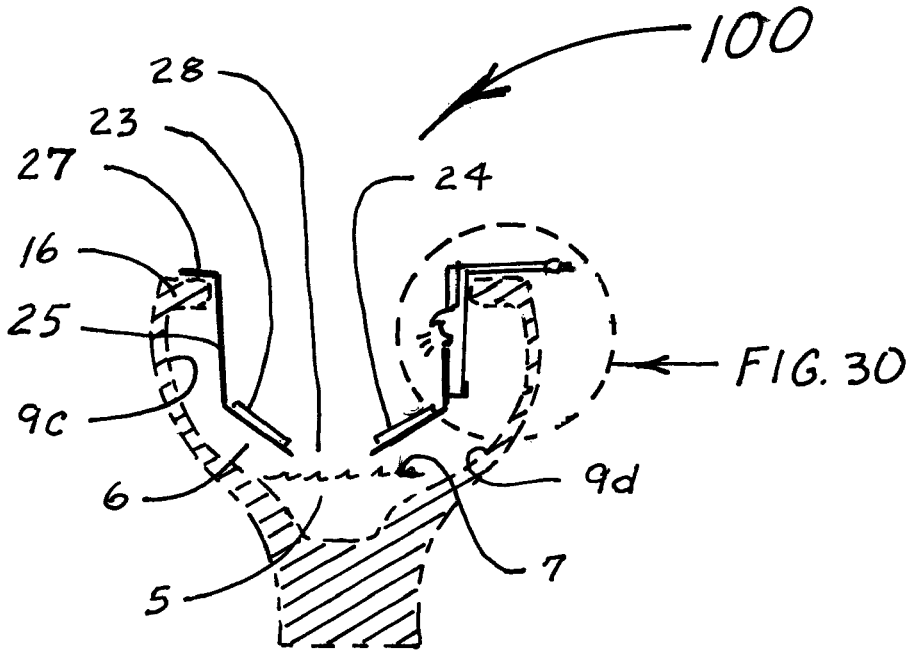
FIG. 29 is a front sectional view of one embodiment of the anal-genital viewing device disposed in a toilet bowl.

Whether the device 100 is designed to rest on the rim 16 or be attached to the underside of the toilet seat 15, the forward mirror 10 is attached to the frame 29 such that the forward mirror 10 is adjacent the front wall 9*a* of the toilet bowl 4 and the rear mirror 11 is attached to the frame 29 such that the rear mirror is adjacent the rear wall 9*b* of the toilet bowl 4 thus affording the user 2 the proper line of sight 12 allowing the user 2 a direct upward view of the anal-genital region 3 (see FIG. 25). The forward mirror 10, the rear mirror 11 and optional side mirrors or additional forward mirrors could be an integral part of the frame 29 or preferably either permanently or removably attached to the frame 29 with hinges or other suitable fasteners as shown in FIGS. 21-24. If an integral part of the frame 29, the frame 29 would preferably be made of a bendable metal so as to allow adjustment of the front mirror 10, rear mirror 11 and optional side mirrors. FIGS. 21-24 shows embodiments of the device in a frame 29 wherein the forward mirror 10 is attached to the frame 29 by hinges (preferably friction) 35, 36 and the rear mirror is attached to the frame 29 by hinge (preferably friction) 37. Hinges 35, 36, 37 permit adjustment of the angles of mirrors 10, 11 to suit various user preferences as well as permitting mirrors 10, 11 to rotate upward into the plane of the flat frame 29 for convenience of storage and transporting. FIG. 23 shows the mirrors 10, 11 rotated upward into the plane of the frame 29 and extended across the frame 29 in a position desirable for storage and transport. FIGS. 21, 22 and 25 show the device resting on the rim 16 substantially as it would be disposed in a toilet bowl 4 with the front mirror 10 and the rear mirror 11 folded down into the void area 6 to afford the proper line of sight 12 as discussed above. Hinges 35, 36, 37 allow simple and convenient means of manually adjusting the vertical angles of mirrors 10, 11 to accommodate varying lines of sight 12 of user 2 that correspond to various postures assumed by the user 2 as well as particular user's height and weight. Hinges 35, 36 could be replaced by or supplemented with devices such as swivels, pivots or stay-put gooseneck tubing to provide omnidirectional positioning of forward mirror 10 and/or rear mirror 11 in accordance with the invention.

In this embodiment as well as the embodiment shown in FIGS. 23-24, hinges may optionally be inserted on both sides of the frame 29 at locations denoted 38 in the sides of the flat frame 29 allow the frame to fold at those locations permitting further compaction of the device for storage and transport. Hinges 35, 36, 37, 38 may be any type hinges commonly available in the art, including but not limited to living hinges, fixable-position hinges, standard hinges, friction hinges or various combinations thereof. Friction hinges or other hinges that hold any position desired by the user are preferred.

Similar to previously described embodiments, the forward mirror 10 may be attached to frame 29 at any point in the front half of the frame 29, corresponding to the range of positions within the toilet bowl from 10R to 10L illustrated in FIG. 9. Alternatively, more than one forward mirror and/or side mirrors adjacent to the side walls 9*c*, 9*d* of the toilet 4 may be attached to frame 29 to concurrently provide alternative lines of sight 12 to the user 2 similar to the configurations shown in FIGS. 11-14 or FIGS. 26-29. These alternative lines of sight 12 could be particularly useful to provide simultaneous viewing by a caregiver and the person seated on the toilet.

Rather than the frame 29 being held in place by the lowered toilet seat 15, the frame 29 could be attached directly to the underside of the toilet seat 15. FIGS. 23 and 24 show an embodiment of the device 100 disposed in a frame 29 in which the frame 29 is attached to the underside of toilet seat 15 by means of insertion of forward tab 45 and rear tab 46 located on the frame 29 into forward slotted receiver 50F and rear slotted receiver 50R located on the underside of the toilet seat 15, respectively. Preferably, the length of the forward tab 45 is approximately twice the length of the rear tab 46. In one such embodiment the frame is attached to the underside of the toilet seat 15 by first slipping forward tab 45 into the forward slotted receiver 50F, then aligning rear tab 46 with the slot in the rear receiver 50R and lowering the frame until the lower edges of the frame 29 rest upon rear slotted receiver 50R and/or upon toilet seat hinges 17. Slotted receivers 50F, 50R are positioned on the underside of toilet seat 15 such that the forward half of forward tab 45 remains within the forward slotted receiver 50F when rear tab 46 is fully inserted within the rear slotted receiver 50R. Use of tabs and slotted receivers is one of numerous means of attaching the frame 29 to the toilet seat. For example, the frame 29 may alternatively be attached to the underside of toilet seat 15 by a wide variety of methods, including but not limited to hook and loop Velcro, double adhesive mounting tapes, mated fasteners, clips, suction cups or magnets in accordance with the invention.

As shown in FIGS. 21 and 22, an illumination component 30 may optionally be attached to the frame 29 as well. One or more illumination devices 30 may be magnetically attached to metal strips imbedded in or attached to the underside of frame 29 at a position on the frame 29 that overhangs toilet void space 6 and is not obstructed by rim 16. Alternatively, illumination component 30 could be attached above forward mirror 10 or rear mirror 11 as shown in FIGS. 19 and 20, attached to a rim clip 31 as shown in FIG. 4, or attached directly to the frame.

FIGS. 26-29 illustrate another embodiment of the anal-genital self-viewing device 100 according to the invention, whereby a forward mirror 10, a rear mirror 11, and optionally a right side mirror 23 and/or a left side mirror 24 are disposed in and encircled by a rigid or semi-rigid housing 25 with integral lip 27 which housing is then disposed into the toilet bowl 4. The mirrors 10, 11, 23 and 24 in the embodiment illustrated are attached to or built into the housing in positions at angles that create the proper line of sight 12 as discussed with respect to the embodiments described above and illustrated in FIGS. 2, 6, 10, 18 and 25 for example.

The housing 25 is open at the top and at the bottom 28. In some installations the bottom 28 of the housing 25 may be allowed to go below the high water line 7, although that configuration would not be preferred. The housing is preferably sized and shaped so as to preserve a space between the inside bowl surface 9 of the toilet bowl 4 and the housing 25 such that the normal flushing operation of the toilet bowl 4 is preserved unhindered by the presence of the housing 25. The housing 25 drops into the void area 6 of the toilet bowl 4 and is suspended within the void area 6 of the toilet bowl 4 by means of the flared lip 27, which flared lip 27 rests on and is supported by the rim 16 of the toilet bowl 4.

It should be appreciated that this embodiment of the device 100 may comprise many combinations and number of forward, rear and side mirrors many of which were disclosed with respect to embodiments discussed above. For example, the device 100 in a housing 25 may include only a forward mirror 10 and a rear mirror 11 or may also include either or both side mirrors 23, 24. Alternatively, the forward mirror 10 or multiple forward mirrors may be placed anywhere along the housing in positions similar to those shown between locations 10R and 10L on FIG. 9. Although other embodiments discussed above may provide optimum adjustability, this embodiment may be particularly convenient for concurrent viewing by a caregiver and a person seated on the toilet in that multiple front mirrors 10 or the front mirror 10 and side mirror 23 or 24 could be factory-fixed at angles that establish two well-separated lines of sight 12 to best accommodate viewing by a caregiver and the person seated on the toilet. The housing 25 could be made of any material sufficiently strong to support the mirrors 10, 10R, 10L, 11 and by a large variety of manufacturing methods as is known in the art.

Figure 30:
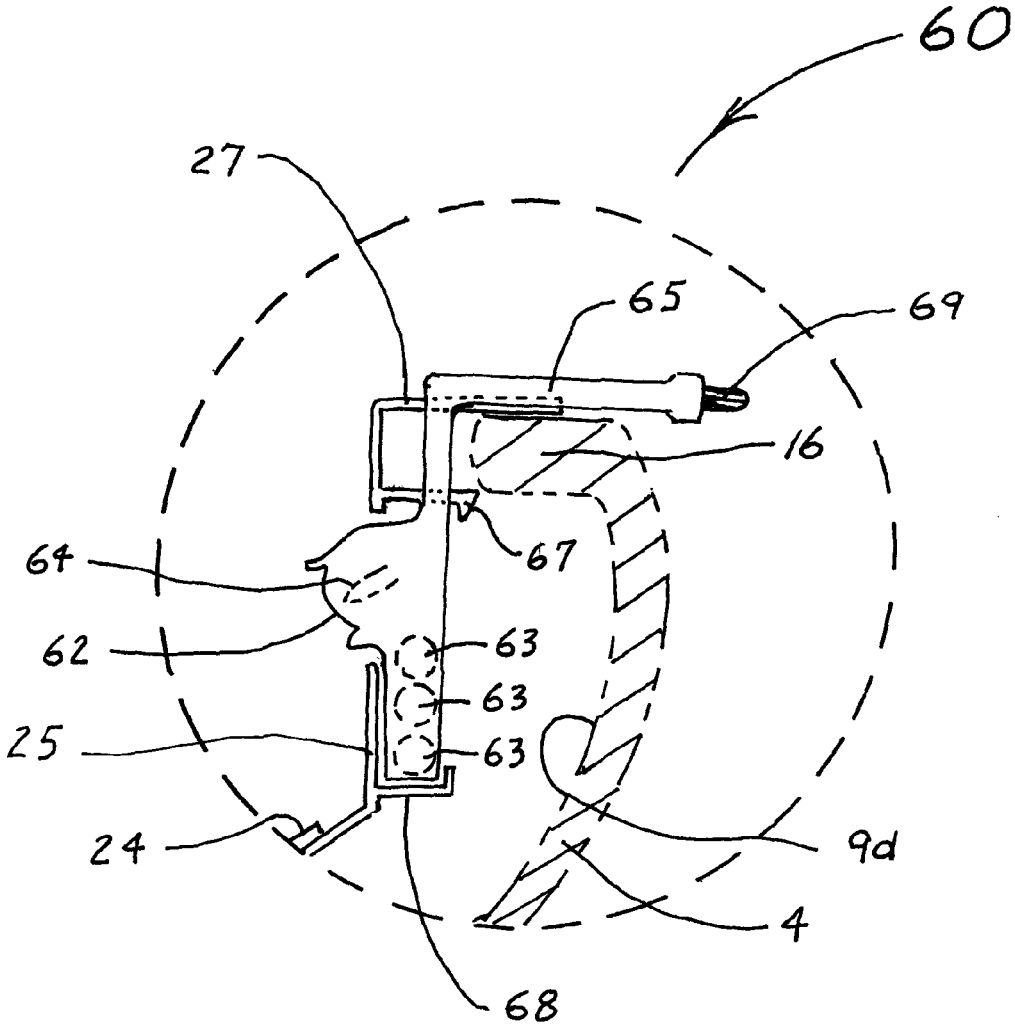
FIG. 30 is an enlarged sectional view of the illumination component of one embodiment of the anal-genital viewing device disposed in a toilet bowl.

As in other embodiments discussed herein, the device 100 in this embodiment is best used with an illumination source. Any of the illumination sources discussed above may be used. FIG. 30 is an enlarged drawing of another possible illumination device 60 that is particularly adapted for use with the housing 25. The illumination source 60 comprises a substantially transparent lens 62 that fits through an opening in the side of the housing 25, bulb(s) 64 optionally LED bulbs, a power source 63, optionally batteries and an ON/OFF switch 69 located externally to the toilet bowl 4 by means of a tube 65 containing connective electrical wiring; said tube 65 fits in the space between the rim 16 and the toilet seat 15 (not shown). The illumination component 60 is supported on a shelf 68 extending from the housing 25 and held in place by means of a retainer clip 67. The illumination device 60 may be installed in either side or both sides of the housing 25. The illumination device 60 may be detachable to simplify replacement of the power source 63, the LED bulb 62 and/or for cleaning or replacement of the illumination device 60 in its entirety. The illumination device shown comprises three batteries wired in series and five LED bulbs, however various other configurations of illumination sources similar to illumination device 60 or illumination source 30 comprising different materials, power sources, types and number of batteries, types and number of lights and locations may be also be used.

What is claimed is:

1. A device for viewing the anal-genital region of a person seated on a toilet above a toilet bowl, the device comprising:

at least one front mirror and a rear mirror, said mirrors positioned in said toilet bowl to provide at least one line of sight from outside said toilet to said anal-genital region, wherein said mirrors are positioned without said mirrors obstructing said toilet bowl directly below the person's anal-genital region and wherein said line of sight reflects off said at least one front mirror to said rear mirror and reflects off said rear mirror upward toward said person's anal-genital region.

2. The device of claim 1 wherein said mirrors are attached to the seat of said toilet.

3. The device of claim 1 including means for adjusting said line of sight.

4. A device for viewing the anal-genital region of a person seated on a toilet above a toilet bowl, the device comprising:

at least one front mirror;

a rear mirror; and means for positioning said mirrors in said toilet to provide at least one line of sight from outside said toilet to said anal-genital region without said mirrors physically obstructing said toilet bowl directly below the person's anal-genital region such that said line of sight reflects off said at least one front mirror to said rear mirror and reflects off said rear mirror upward toward said person's anal-genital region.

5. The device of claim 4 including means for adjusting said line of sight.

6. A method for viewing the anal-genital region of a person seated on a toilet above a toilet bowl, the method comprising:

positioning at least one front mirror and one rear mirror in said toilet to provide at least one line of sight from outside said toilet to said anal-genital region, wherein said mirrors are positioned without said mirrors physically obstructing said toilet bowl directly below the person's anal-genital region such that said line of sight reflects off said at least one front mirror to said rear mirror and reflects off said rear mirror upward toward said person's anal-genital region.

* * * * *